US006331965B1

(12) United States Patent
Sato et al.

(10) Patent No.: US 6,331,965 B1
(45) Date of Patent: Dec. 18, 2001

(54) PORTABLE DEVICES AND TRANSMITTING/RECEIVING SYSTEMS INCLUDING THE PORTABLE DEVICES

(75) Inventors: Yoshinori Sato, Higashine; Katuo Suzuki, Murayama; Osamu Ito, Yamagata-ken; Yoshiichi Tokairin, Tendo, all of (JP)

(73) Assignees: Casio Computer Co., Ltd.; Yamagata Casio Co., Ltd., both of Yamagata-ken (JP)

( * ) Notice: Subject to any disclaimer, the term of this patent is extended or adjusted under 35 U.S.C. 154(b) by 0 days.

(21) Appl. No.: 09/184,833

(22) Filed: Nov. 2, 1998

(30) Foreign Application Priority Data

Nov. 4, 1997 (JP) ..... 9-317671
Dec. 12, 1997 (JP) ..... 9-011488
Dec. 12, 1997 (JP) ..... 9-362979

(51) Int. Cl.[7] ..... G04B 47/00
(52) U.S. Cl. ..... 368/10; 368/47

(58) Field of Search ..... 368/10, 47, 281, 368/282

(56) References Cited

FOREIGN PATENT DOCUMENTS 62-34842 2/1987 (JP) .
09-224074 8/1997 (JP) .
10-013960 1/1998 (JP) .

*Primary Examiner*—Bernard Roskoski
(74) *Attorney, Agent, or Firm*—Frishauf, Holtz, Goodman Langer & Chick, P.C.

(57) ABSTRACT

An wristwatch contains a time register mechanism within a watch case and an intervening member which contains a signal reception detecting/reporting device that detects/reports a signal received at a portable terminal. When there is a received signal at the portable terminal 1, respective lamps are turned on/off in accordance with a predetermined pattern. A device body which contains the signal reception detecting/reporting device, may be provided with a connector which is engaged at opposite ends with the device body.

5 Claims, 32 Drawing Sheets

PORTABLE DEVICES AND TRANSMITTING/RECEIVING SYSTEMS INCLUDING THE PORTABLE DEVICES

BACKGROUND OF THE INVENTION

The present invention relates to portable devices carried about by users and transmitting/receiving systems including the portable devices.

One of conventional portable devices, for example, a wristwatch disclosed in Published Unexamined Japanese Patent Application Sho 59-31322 includes a watch body which has opposite concave ends engaged through spring rods to bands with one band extending through a case which contains a calling vibrator for reporting reception of a signal at a portable telephone by vibrations to a user.

Therefore, the case and the band add in thickness in the case area and the resulting total thickness is large. Thus, when the wristwatch is carried about by a user, it can interfere with another person or his or her belongings to hinder his or her behavior as well as the case can be damaged so that a device set within the case can malfunction.

In the area of the case, a back of the case which contacts with the user's wrist is raised toward the user's wrist relative to a back of the band which extends through the case. Thus, when the band is tightened around the user's wrist, the back of the case would press the user's wrist to give a feeling of discomfort to the user.

The bands are rolled up and thicker at one end than their other portions. Through those rolled-up ends the corresponding spring rods are inserted, so that the case cannot be disposed close to the watch body. Thus, a design which gives a feeling that the watch body and case are formed as a unit cannot be obtained, which places restrictions on design.

It is therefore an object of the present invention to provide a portable device which suppreses an increase in its thickness in the case area and eliminates a feeling of discomfort given when the device is worn, and which improves the degree of freedom in design.

Another object of the present invention is to provide a portable device which has versatility, excellent fixing performance and an excellent feeling of wear.

SUMMARY OF THE INVENTION

In order to achieve the above objects, according to the present invention, there is provided a portable device including a wristwatch body carried about by a user, comprising:

putting-on means for putting the wristwatch body on the user;

an intervening member for engaging the putting-on means with the wristwatch body; and function realizing means provided in the intervening member for realizing a predetermined function.

According to the present invention, since the intervening member is provided to engage the wearing means with the watch body, only the thickness of the intervening member itself acts as a quantity having a raising effect. Thus, a problem caused due to the raising effect of the intervening member is avoided as well as a feeling of discomfort which would otherwise be caused when the watch is worn on the user's wrist is avoided. The watch body can be disposed close to the intervening member without any limitation, so that a design which gives a feeling that the watch body and the intervening member which contains the device are formed as a unit can be provided.

In another aspect, the present invention provides a portable device comprising a body in which a display unit for displaying data is provided, comprising:

putting-on means for putting said device body on a user; and a receiving unit provided on said putting-on means for receiving an external signal and for reporting to the user that there is a received external signal on the basis of the received external signal, the device body and the putting-on means are arranged on the same smooth surface (FIG. 2B) which is brought into contact with the user for putting the device body on the user.

According to the present invention, the portable device which has a function of reporting reception of an external signal to the user gives no feeling of discomfort in an area containing the device body and the putting-on members when the device is put on around the user's wrist.

DESCRIPTION OF THE PREFERRED EMBODIMENTS

Embodiments of the present invention will be described below with reference to the accompanying drawings.

Figure 1:
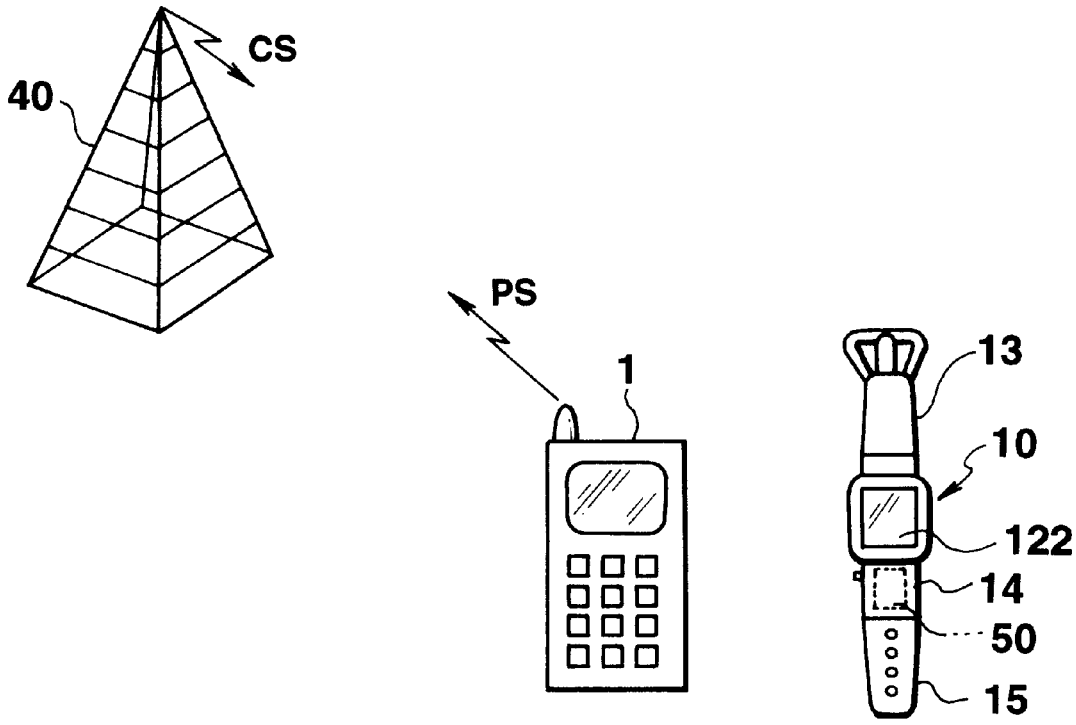
FIG. 1 illustates a whole composition of a wireless telephone system as a first embodiment of the present invention.

FIG. 1 shows a whole composition of a wireless telephone system as a first embodiment of the present invention. In FIG. 1, reference numeral 1 denotes a personal telephone; 10 a wristwatch; 50 a signal arrival detecting/reporting device provided on the wristwatch 10; and 40 wireless base station which sends a down signal CS to the personal telephone 1 and receives an up signal PS from the personal telephone 1 to relay communication.

Figure 2A:
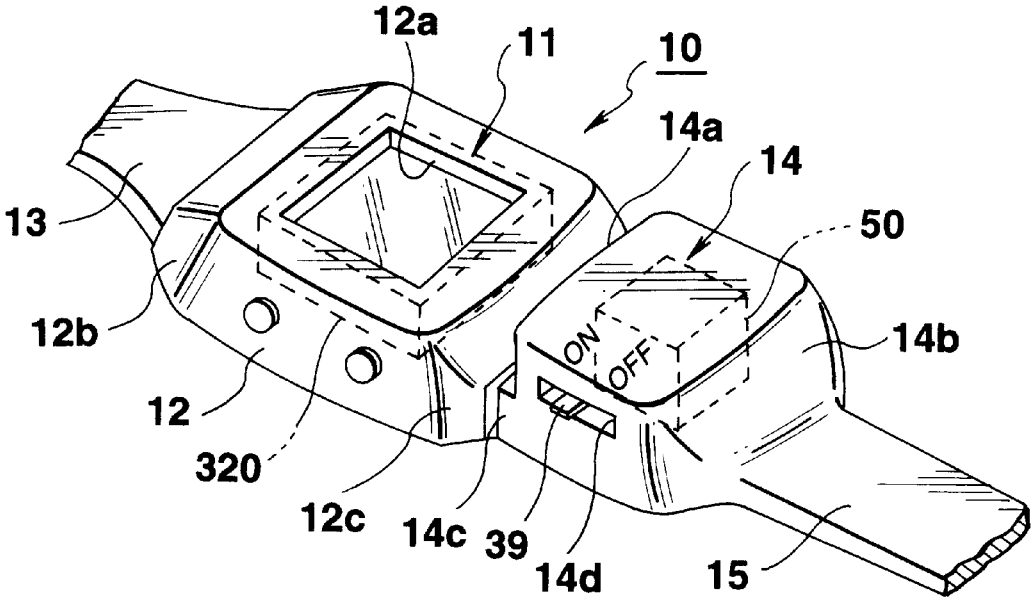
FIG. 2A is a perspective view of a wristwatch used in the system.

As shown in FIG. 2A, the wristwatch 10 comprises a watch body 11 whose case 12 contains a watch side circuit 120 such as a time register.

The case 12 has a display window 12*a* on its upper surface with opposite sides thereof having corresponding concave ends 12*b* and 12*c* engaged with a band 13 and an intervening member 14, respectively, in the vicinity of the back surface thereof.

The intervening member 14 takes the form of a hollow trapezoid with a smooth back surface and has substantially the same thickness as the watch body 11. The intervening member 14 has opposite sides 14*a* and 14*b* from lower portions of which a convex engaging end 14*c* and the other band 15 extend. The intervening member 14 has a slit 14*d* on another side thereof.

The other band 15 is engaged through the convex engaging end 14*c* of the intervening member 14 in the concave end 12*c* of the watch case 12.

The signal reception detecting/reporting device 50 is disposed within the intervening member 14 with an on/off switch 39 protruding outward through the slit 14*d*.

Figure 2B:
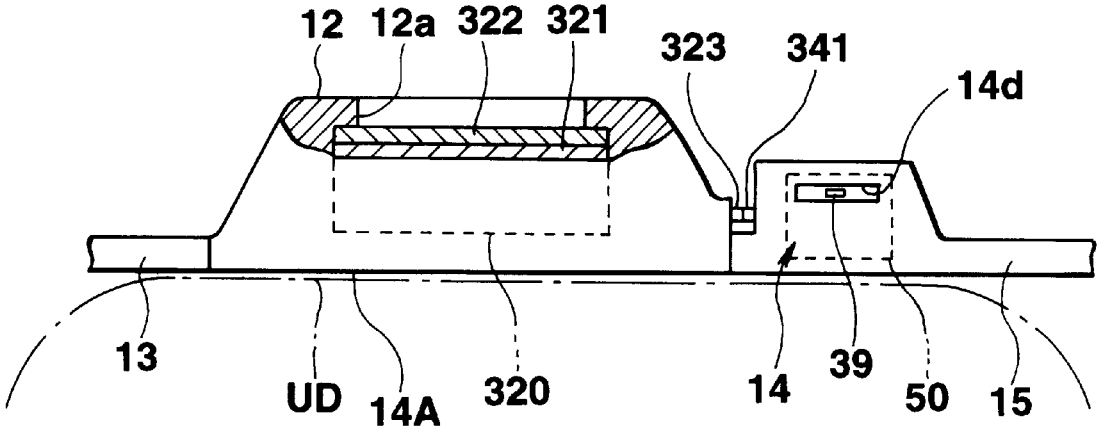
FIG. 2B is a front view of the wristwatch.

As shown in FIG. 2B, the respective elements; that is, bands 13, case 12, intervening member 14 and band 15 of the wristwatch 10 are arranged on the same surface so that when the wristwatch 10 is worn on a user's wrist, it keeps close contact with the user's wrist.

As shown also in FIG. 2B, an electroluminescence (EL) element 121 and a liquid crystal display (LCD) 122 are plased on the watch side circuit 120. The case 12 has a protruding terminal 123 which is in contact with a terminal 141 of the intervening member 14.

When the personal telephone 1 receives and detects a down call signal CS with a telephone address transmitted at predetermined intervals of time or TDMA (Time Division Multiple Access) frame of 5 ms from the wireless base station 40 and sends an up response signal PS at predetermined intervals of time or TDMA frame of 5 ms to the base station 40, the signal reception detecting/reporting device 50 receives and detects the response signal PS and drives a built-in vibrator 37A to generate vibrations to thereby inform the user of reception or arrival of a signal at the wristwatch.

Figure 3:
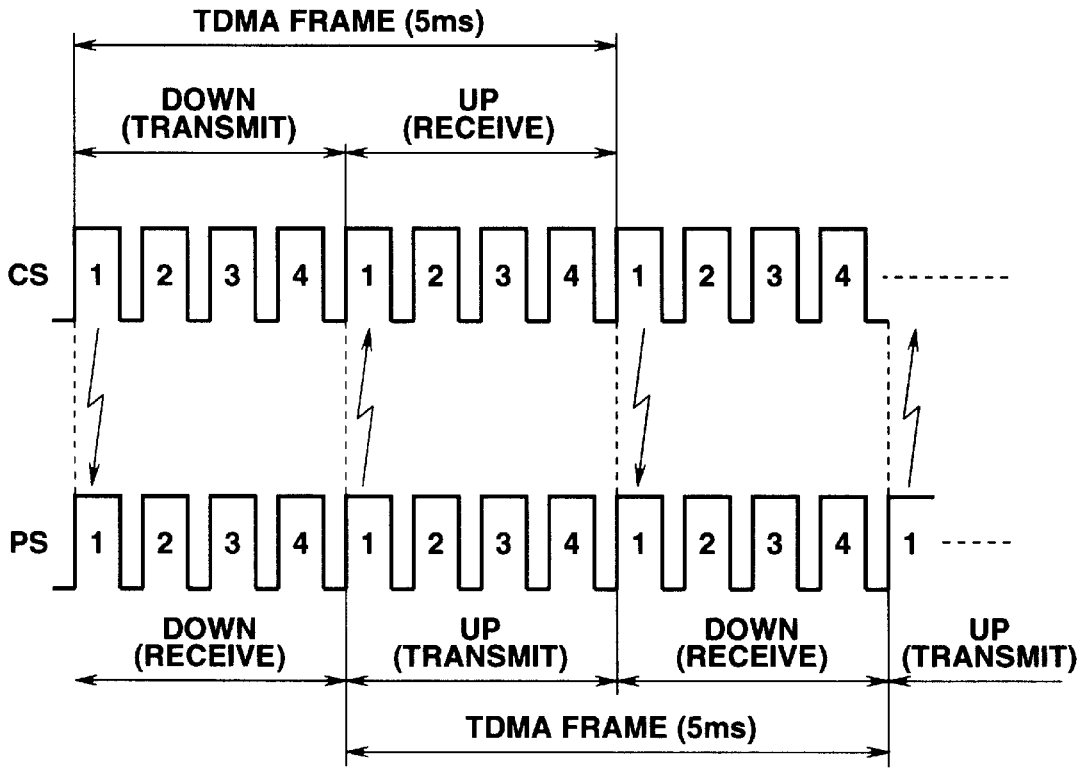
FIG. 3 is a timing chart of reception and transmission of a down base station signal CS and an up telephone signal PS based on a TDMA basis in the wireless telephone system.

FIG. 3 is a timing chart of transmission and reception of the down base station signal CS and the up telephone signal PS generated on a TDMA base in the wireless telephone system.

On the TDMA basis, the wireless base station 40 communicates with a plurality of (in this embodiment, four) personal telephones 1 at intervals of a frame of 5 ms. Thus, a plurality of (in this embodiment, four) independent channels CS1–CS4 is allocated on a time divisional base to the corresponding plurality of personal telephones 1 for receiving a corresponding plurality of down base station CS signals.

In this case, the respective personal telephones 1 send up response signals PS to the base station 40 in their corresponding channels PS1–PS4 a half frame (2.4 ms) after receiving the respective down base station signals CS so as to achieve time-divisional communication.

That is, when a personal telephone 1 is allocated communication in a channel 1 in the TDMA frame and receives a down base station signal CS from the wireless base station 40, the telephone 1 sends an up response signal PS in the channel CH 1 a half frame later. In this case, the down signal CS from the base station 40 and the up response signal PS from the telephone 1 are both sent at intervals of a frame of 5 ms with a shift of a half frame (2.5 ms) in accordance with a predetermined protocol.

When a personal telephone 1 comes into a service area of the base station, the user of the telephone re-enters its use in the service area in the base station 40 for enjoying services from the base station (which is hereinafter referred to as position entry). This procedure requires 3.5 seconds at most.

The signal reception detecting/reporting device 50 synchronously receives and detects response signals PS sent from the telephone 1 to the base station at intervals of a frame (5 ms) and also detects whether repetition of the response signals PS at intervals of the frame has continued for more than 3.5 ms to determine whether the communication relates to the position entry of the telephone 1 or processing for a call signal. If the response signal relates to processing for the call signal, the reporting device 50 determines that a call signal has been received by the telephone 1.

Figure 4A:
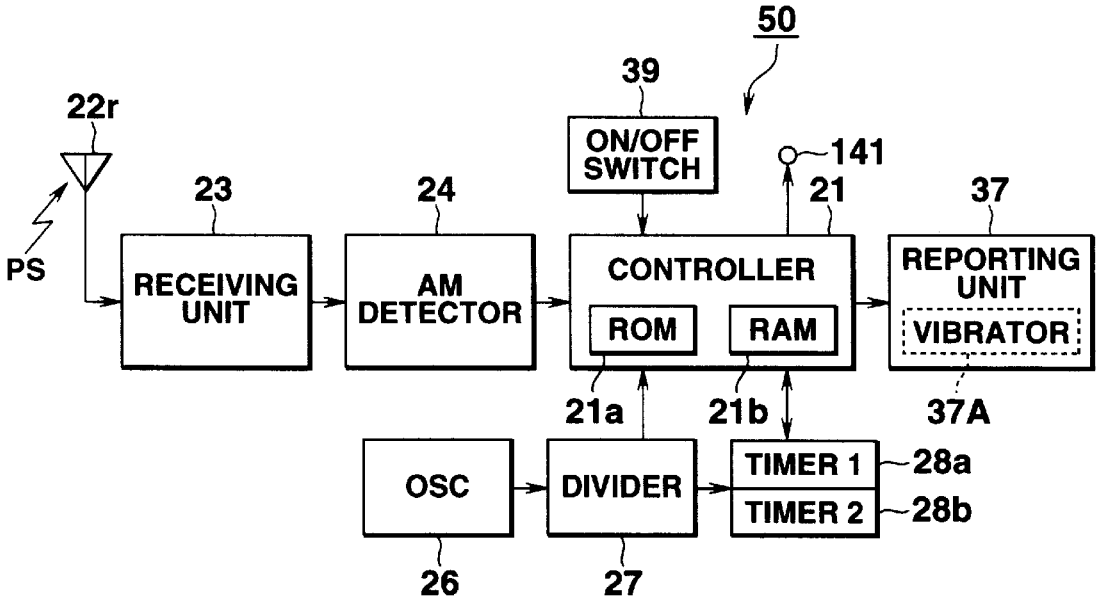
FIG. 4A is a block diagram of a signal reception detecting device.

FIG. 4A is a block diagram of the detecting reporting device 50, which includes a controller 21 as a computer having a CPU which controls the operation of respective elements of the device 50 in accordance with a signal reception detecting/reporting program stored in a built-in ROM 21*a* or a signal reception detecting program read into a built-in RAM 21*b* of the controller 21 from an external recording medium (not shown).

The reporting device 50 further includes an antenna 22*r* which receives an up response signal PS, a receiving unit 23, an AM detecting device 24, an on/off switch 39, an oscillator 26, a frequency divider 27, a first timer 28*a*, a second timer 28*b* and a reporting unit 37.

A signal in a predetermined frequency band for the personal telephone 1 received by the receiving unit 23 via the antenna 22*r* is shaped via the AM detecting device 24 into a square signal, which is then delivered to the controller 21.

An oscillation signal of a predetermined frequency generated by the oscillator 26 is changed by the frequency divider 27 to a basic clock, which is then delivered to the controller 21, and the first and second timers 28*a* and 28*b*.

When the received signal is delivered to the controller 21, the first timer 28*a* starts to measure 3.5 s corresponding to the longest communication time required for the position entry of the personal telephone 1 between the telephone 1 and the base station 40. The second timer 28*b* starts to measure 5 ms corresponding to an interval of transmission time (one TDMA frame) of an up response signal PS from the telephone 1.

The controller 21 sends a report instruction signal to the reporting unit 37, which then drives the built-in vibrator 37A to report the responding operation of the telephone 1 by vibrations to the user. The terminal 141 (FIG. 2B) is connected to the controller 21.

Figure 4B:
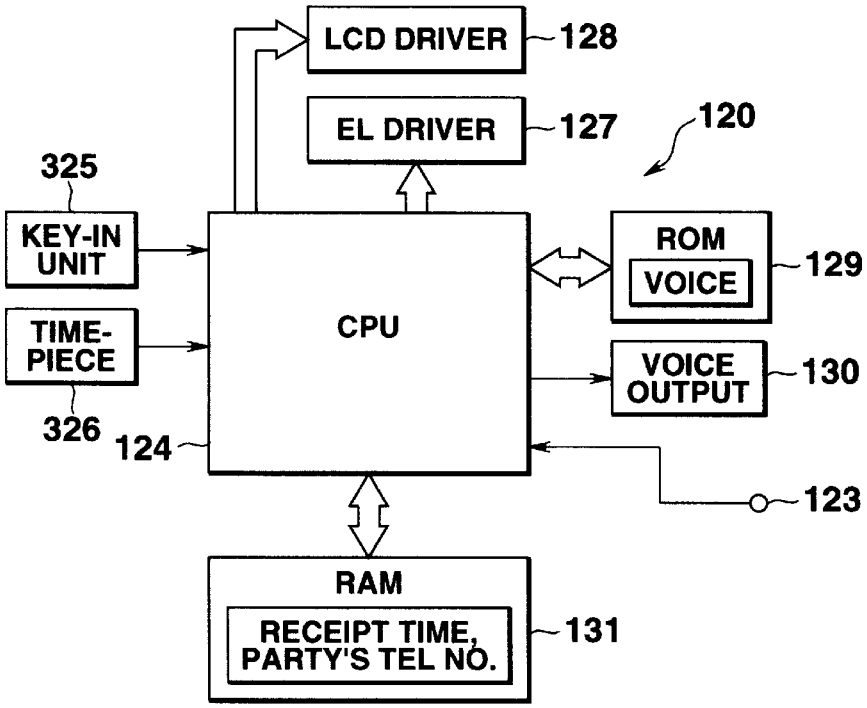
FIG. 4B is a block diagram of a watch side circuit.

FIG. 4B is a block diagram of the watch side electronic circuit 320, which includes a CPU 124 which is connected to a key-in unit 325, a timepiece unit 326, an EL driver 127, a LCD driver 128, a ROM 129, a voice output unit 130, a RAM 131, and the terminal 323 (FIG. 2B).

The key-in unit 325 is provided with various keys outside the case 12 and generates a signal depending on a respective key when depressed. The timepiece unit 326 outputs a signal representing the present time.

The EL driver 127 and the LCD driverl28 drive the EL 322 and LCD 322, respectively.

The ROM 129 contains programs and voice data which report signal reception and the time when the signal reception occurred. The voice output unit 130 includes a speaker which reproduces the voice data.

The RAM 131 is used as a work area as well as a memory area where a time when a call is received by the telephone 1 and a telephone number of the caller are stored.

When the case 12 is engaged at its concave end with the convex end 14*c* of the intervening member 14, both the terminals 323 and 341 are brought into contact with each other, and the watch side circuit 320 is connected via the terminals 323 and 341 to the signal arrival detecting/reporting device 50. In this state, the CPU 124 causes the EL 321 to emit light to report that both the watch side circuit 320 and the reporting device 50 are placed in proper electrical connection.

Light emission from the EL 321 may continue only for a predetermined time or limitlessly after the connection is established. When the intervening member 14 is removed from the case 12, the EL 321 is turned off.

In a state where the case 12 and the intervening member 14 are connected to each other, the reporting device 50 is set within the intervening member 14, and the intervening member 14 intervenes between the band 11 and the watch body 11. However, arrangement of the reporting device 50 within the intervening member 14 serves to avoid a great increase in the total thickness of the intervening member 14 and the reporting device 50, which prevents the intervening member 14 from interfering with another person or his or her belongings to thereby hinder his or her behavior in his or her daily action or from being damaged, so that the signal reception detecting/reporting device 50 enclosed within the intervening member 14 does not malfunction. The back surface of the intervening member 14 is smoothed. Thus, when the wristwatch 10 is worn around the user's wrist by the bands 13 and 15 and the intervening member presses the user's wrist at its back, it does not give a feeling of discomfort to the user.

Since the intervening member 14 is engaged directly at its convex engaging end 14*c* with the corresponding concave end 12*c* of the watch body 11, a design which gives a feeling that the watch body 11 and the intervening member 14 are formed as a unit is obtained to thereby improve the degree of freedom of design.

When the wireless telephone system which includes the personal telephone 1 and the wristwatch 10 which, in turn, includes the signal reception detecting/reporting device 50 is used, the wristwatch 10 is worn around the user's wrist by the bands 13 and 15, and then the on/off switch 35 is turned on. A signal receiving mode is then set in which no signal reception is sounded in the telephone 1, and the wristwatch 10 is then put into the user's bag or briefcase.

When in this state the telephone 1 receives a down call signal CS including the telephone's address sent by the base station 40 and sends an up response signal PS at predetermined intervals of time or TDMA frame of 5 ms to the base station 40, the reporting device 50 receives the up response signal PS via the receiving antenna 22*r*. This signal is AM detected by the AM detecting device 24 and the resulting signal is delivered to the controller 21.

Figure 5:
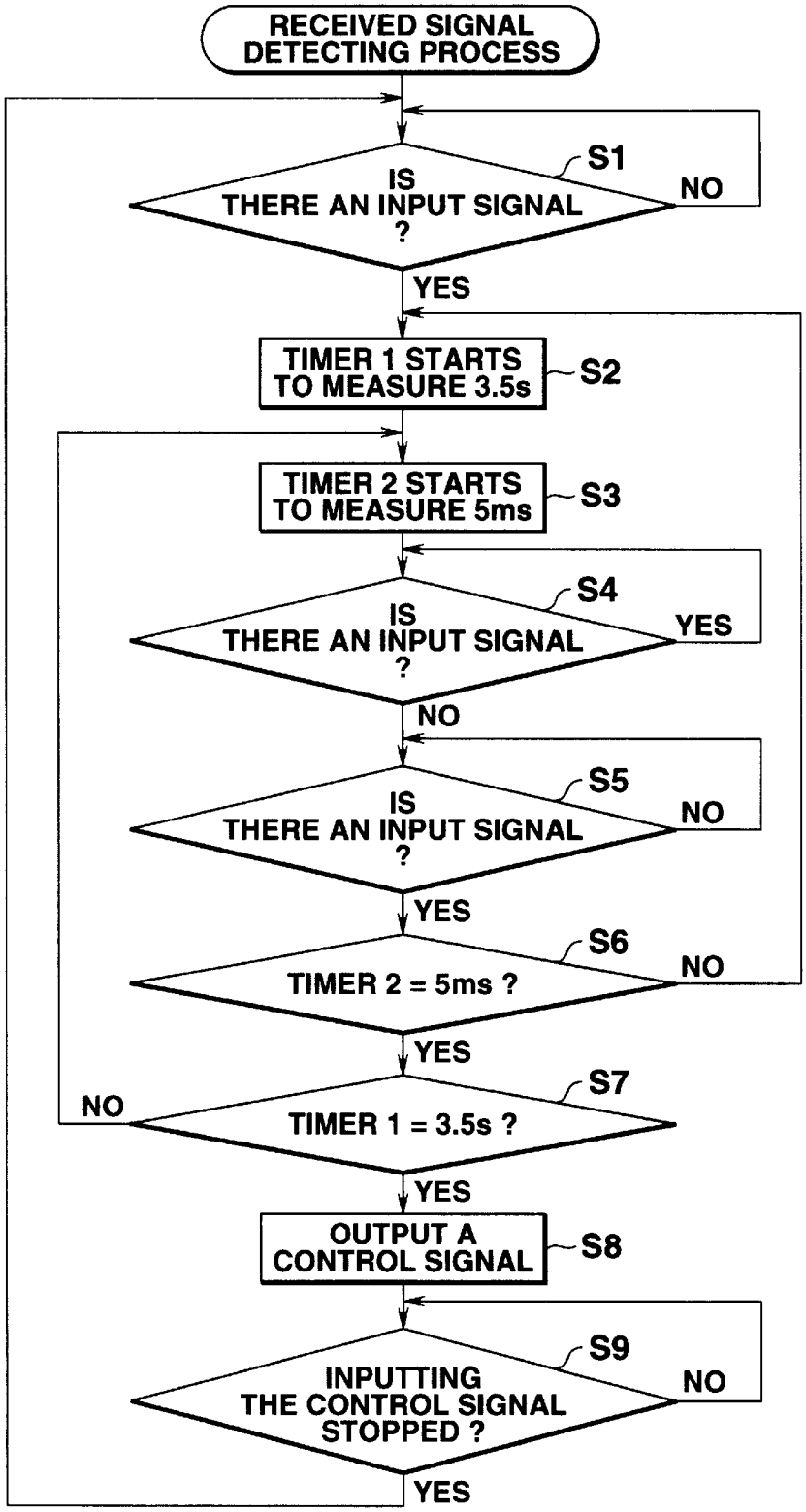
FIG. 5 is a flow chart of a signal reception detecting process performed by the signal reception detecting/reporting device.

The reporting device 50 operates in accordance with a flow of a signal reception detecting process of FIG. 5. Thus, the controller 21 determines that there is an input signal and causes the first and second timers 28*a* and 28*b* to start to measure 3.5 s and 5 ms, respectively (steps S1, S2, S3).

When the telephone 1 does not temporarily receive a response signal PS one cycle later, so that the controller 21 determines that there is no input signal (step S4), and the reporting device 50 then receives the next up response signal PS sent a predetermined interval of 5 ms later from the telephone 1, so that the controller 21 again determines that there is an input signal (step S5), the controller 21 determines whether the second timer 28*b* has measured 5 ms or determines whether the received signal in the reporting device 50 for which the controller 21 has determined that there is the input signal is truly the up response signal PS sent by the telephone 1 (steps S4, S5, S6).

When the controller 21 determines that (1) there is an input signal at step S5, (2) the second timer 28*b* has measured 5 ms at step S6, and (3) the up response signal PS from the telephone 1 has been truly received, the controller 21 further determines whether the first timer 28*a* has measured 3.5 s from the time when the first up response signal PS has been received at step S1 or whether reception of the up response signal PS sent from the telephone 1 has continued for more than 3.5 s corresponding to the longest communication time required for the position entry of the telephone 1 (steps S6, S7).

If the controller 21 determines that the first timer 28*a* is under measurement of 3.5 s, the controller iterates processing at steps S3–S7 for confirmation of reception of an up response signal PS sent by the telephone 1.

When the controller 21 determines that reception of the up response signal PS from the telephone 1 has continued for more than 3.5 s, so that the first timer 28*a* has measured 3.5 s, and confirms that transmission of a response signal PS from the telephone 1 is not for the position entry of the telephone 1, but for reception of the signal by the telephone 1, the controller 21 outputs a control signal to the reporting unit 37 (steps S7, S8). In response to this signal, the vibrator 37A of the reporting unit 37 is driven to generate vibrations, which are transmitted through the intervening member 14 to the user's wrist, so that the user knows that the telephone 1 has received a signal.

Thereafter, for example, when the base station 40 stops transmission of the down call signal CS, the telephone 1 stops sending the up response signal PS. Thus, when the reporting device 50 determines that no up response signal PS has been received, the controller 21 stops delivery of the control signal to the reporting unit 37. Thus, the signal detection or arrival detecting process returns to its initial state so that a standby state starts in which a new up response signal PS from the telephone 1 is monitored (steps S9, S1). In response, the reporting unit 37 stops driving the vibrator 37A to stop reporting the signal reception by the vibrations.

Thus, according to the wireless telephone system of this embodiment, the controller 21 determines whether the signals received via the receiving antenna 22*r* of the reporting device 50 are an up response signal PS from the telephone 1 by determining whether the signals are inputted at intervals of time of 5 ms corresponding to one TDMA frame measured by the second timer 28*b*. In addition, the first timer 28 determines whether the received up response signal PS has continued more than 3.5 s corresponding to the longest communication time required for the position entry of the telephone. If so, the controller 21 determines that the up response signal PS has been sent not for the position entry of the telephone, but for reporting to the base station that the signal has been received, and then causes the reporting unit 37 to drive the vibrator 37A to report the reception of the signal to the user. That is, the reporting device securely detects reception of the signal at the telephone 1 and then reports this fact to the user. For example, when strong radio waves outputted from another portable digital telephone and having a frequency similar to that of the telephone 1 is received in an interfering manner, or an up response signal PS from a telephone 1 involving its position entry transmitted to the base station 40 is received, wrong signal detection and its reporting is prevented.

The receiving unit 23 of the reporting device 50 is capable of receiving not only the response signal PS, but also the down signal CS and a telephone number of a sending party (or caller) from the base station 40 or a telephone number of a sending party via the telephone 1. Receiving the telephone number of the sending party, the controller 21 sends the control signal and the telephone number of the sending party via the terminals 323 and 341 to the watch side circuit 320.

The CPU 124 then reads from the ROM 129 reporting voice data and time voice data representing the present time which the timepiece circuit 326 indicates, and produces corresponding voice from the voice output unit 130. Thus, the user can know reception of the signal and its time based on the voice output. The keys provided on the side of the watch body 11 may be set so that both the signal reception reporting voice and signal reception time reporting voice are generated; only the signal reception reporting voice is generated; only the signal reception time reporting voice is generated; or neither the signal reception reporting voice nor the reception time reporting voice is generated.

In addition, the CPU 124 displays the time when the signal is received and the telephone number of the sending party (or caller) on the LCD 122, and writes those data into the RAM 131. The user who has been advised of reception of the signal (or signal reception) by vibrations of the vibrator 37A watches the LCD 322 of the watch body 11 to easily and rapidly confirm the sending party. By a predetermined key operation, the CPU 124 reads the reception time and the sending party's telephone number stored in the RAM 131 and displays those data on the LCD 322. Thus, when the user re-calls the sending party, the user can visually recognize the reception time and the sending party's telephone number.

Figure 6:
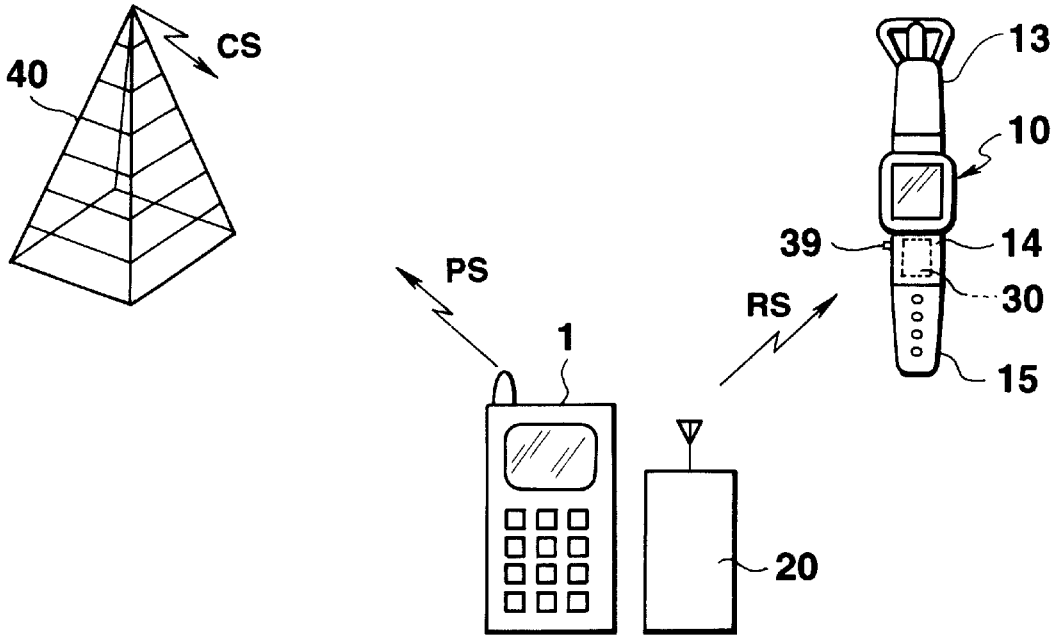
FIG. 6 is a whole composition of a wireless telephone system as a second embodiment of the present invention.

FIG. 6 shows the composition of a whole wireless telephone system as a second embodiment of the present invention. In FIG. 6, reference numeral 1 denotes a personal telephone; 20 a signal reception detecting device which detects the reception or arrival of a signal at the telephone 1; 10 a wristwatch; 30 a signal reception reporting device to report reception of a signal in response to the signal reception or detection by the signal reception detecting device 20.

In the embodiment, unlike the above embodiment comprising the signal reception detecting/reporting device 50, the signal reception detecting device 20 is separated as a unit from the signal reception reporting device 30 which is provided within the intervening member 14.

Figure 7A:
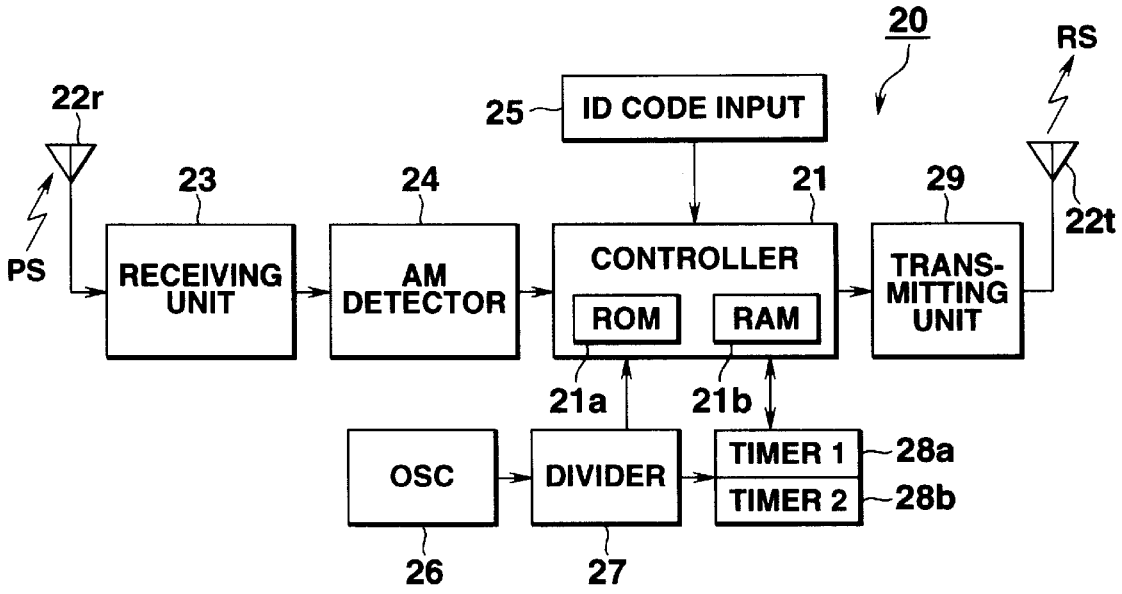
FIG. 7A is a block diagram of a signal reception detecting device used in the telephone system of FIG. 6.
Figure 7B:
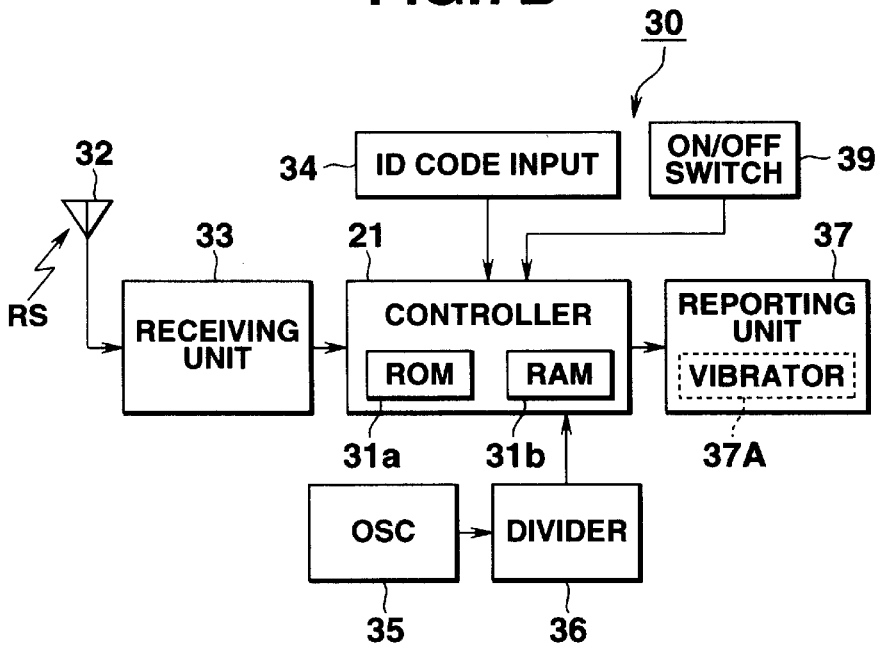
FIG. 7B is a block diagram of a signal reception reporting device used in the telephone system of FIG. 6.

FIG. 7A is a block diagram of the signal reception detecting device 20. FIG. 7B is a block diagram of the signal reception reporting device 30.

The same reference numeral is used to denote similar components of FIGS. 7A and 4A, and further description thereof will be omitted with respect to FIG. 7. In stead of the on/off switch 39 and the reporting unit 37 of the signal reception detecting/reporting device 50 of the first embodiment, an ID code input unit 25 and a transmitting unit 29 are connected to a controller 21 of the signal reception detecting device 20 of this embodiment. A sending antenna 22*t* for a reporting control signal RS is connected to the transmitting unit 29.

Figure 8:
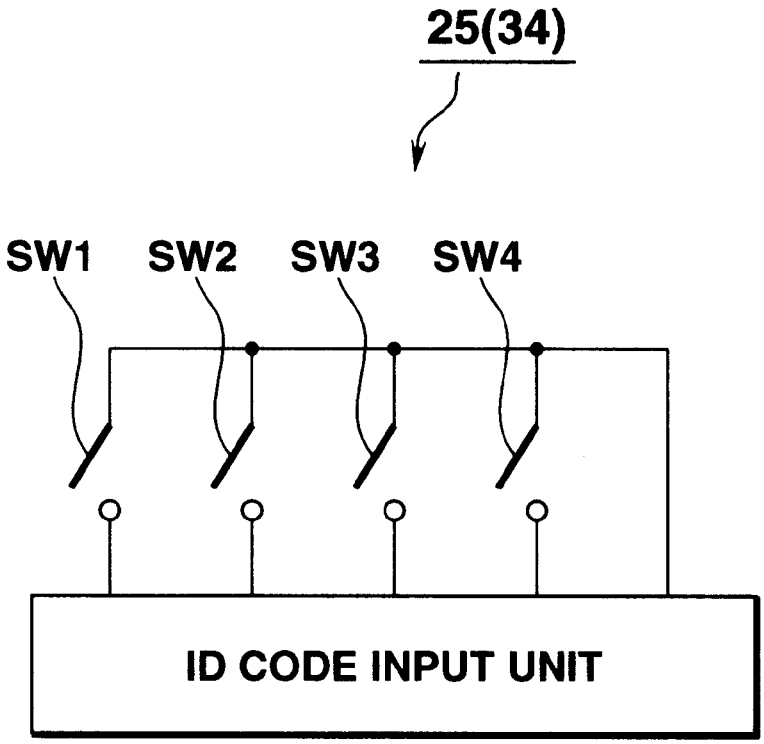
FIG. 8 illustrates a composition of an ID code input unit.
Figure 9:
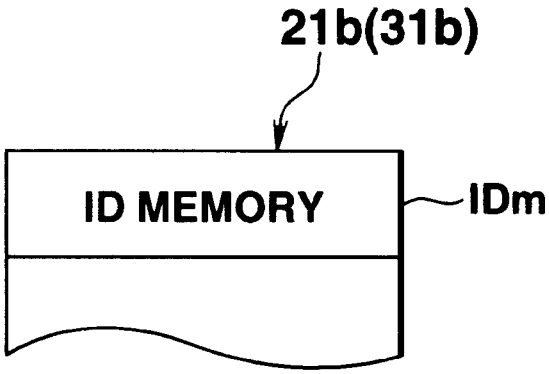
FIG. 9 illustrates a composition of an ID memory.

As shown in FIG. 8, the ID code input unit 25 is provided with switches SW1–SW4 which are operated by the user to input any ID code of 4 bits. The input ID code is stored in an ID memory IDm of the RAM 21*b*of FIG. 9 built in the controller 21 and used as a communication ID for the signal reception reporting device 30.

The signal reception reporting device 30 of FIG. 7B includes a controller 31 in the form of a computer having a CPU which controls the operation of the respective elements of the signal reception reporting device 30 in accordance with a reporting program contained in the ROM 31*a*.

The signal reception reporting device 30 includes a receiving antenna 32 for a reporting control signal RS, a receiving unit 33, an ID code input unit 34, an oscillator 35, a frequency divider 36, a reporting unit 37, and an on/off switch 39, each connected directly or indirectly to the controller 31.

A reporting control signal RS from the signal reception detecting device 20 received by the receiving unit 33 via the receiving antenna 32 is delivered to the controller 31. An oscillation signal having a predetermined frequency generated by the oscillator 35 is divided by the frequency divider 36, and the resulting signal is delivered as a basic clock to the controller 31.

As shown in FIG. 8, like the ID code input unit 25 of the signal arrival detecting device 20, the ID code input unit 34 has switches SW1–SW4 which input any ID code of 4 bits matching an IC code set by the ID code input unit 25 of the signal reception detecting device 20. Thus, the ID code from the ID code input unit 34 is stored in the ID memory IDm (FIG. 9) of the RAM 31*b* built in the controller 31, and used as a communication ID for the signal reception detecting device 20.

When a reporting control signal RS sent by the signal reception detecting device 20 is received by its signal reception detecting operation, the controller 31 determines whether an ID code entrained on the received reporting control signal RS matches an ID code stored in the ID memory 20 IDm of the RAM 31*b* and sends a reporting instruction signal to the reporting unit 37 when the those ID codes matches each other. In response, the reporting unit 37 drives its built-in vibrator 37A to generate vibrations to thereby report to the user by its vibrations that the telephone 1 has received a signal.

As described above, in the embodiment, the signal reception reporting device 30 of FIG. 7B is provided within the intervening member 14 with the on/off switch 39 protruding outside through the slit in the intervening member 14.

When the wireless telephone system which includes the telephone 1, and the wristwatch 10 which includes the signal reception detecting device 20 and the signal reception reporting device 30 in this embodiment are used, the wristwatch 10 is worn by the bands 13 and 15 around the user's wrist and the on/off switch 39 is then turned on. A signal reception mode is set so that no signal reception sound is produced in the telephone, and the telephone is then put along with the signal reception detecting device 20 into the user's bag or briefcase.

In this state, when the personal telephone 1 receives a down call signal CS including an address of the telephone 1 sent by the base station 40 and sends the base station 40 an up response signal PS at intervals of predetermined time or TDMA frame of 5 ms, the up response signals PS sent at intervals of predetermined time are received by the receiving unit 23 of the signal reception detecting device 20 via the receiving antenna 22*r*, and AM detected by the AM detecting device 24, and the resulting signal is delivered to the controller 21.

In response, the signal reception detecting device 20 operates in accordance with a signal reception detecting process flow of FIG. 5. In this flow, at step S8, the signal reception detecting device 20 sends a reporting control signal SR to the signal reception reporting device 30 via the antenna 22*t* from the transmitting unit 29 along with the ID code stored in the ID memory IDm of the RAM 21*b*.

Thus, in the signal reception reporting device 30, the reporting control signal SR from the signal reception detecting device 20 is received by the receiving unit 33 via the receiving antenna 32, and then delivered to the controller 31. When the controller 31 determines that the ID code entraining on the reporting control signal SR received by the signal arrival detecting device 20 matches the ID code stored in the ID memory IDm of the RAM 31*b*, the vibrator 37A of the reporting unit 37 is driven to generate vibrations to thereby report to the user that the telephone 1 has received a signal.

Thereafter, when the wireless base station 40 stops transmission of a down call signal CS, as in the above cases, the telephone 1 also stops sending an up response signal PS to the base station 40. Thus, when the signal reception detecting device 20 determines that reception of the up response signal PS has stopped, the transmitting unit 29 stops transmission of a reporting control signal RS, the signal reception detecting process returns to its initial state, and the signal reception detecting device 20 is placed in a standby state where the reporting device 20 waits for reception of a new up response signal PS from the telephone 1 (step S9, S1). In response to this operation, the signal reception reporting device 30 no longer receives the reporting control signal RS, so that driving the vibrator 37A of the reporting unit 3 and hence reporting the signal reception with vibrations is stopped.

Figure 10:
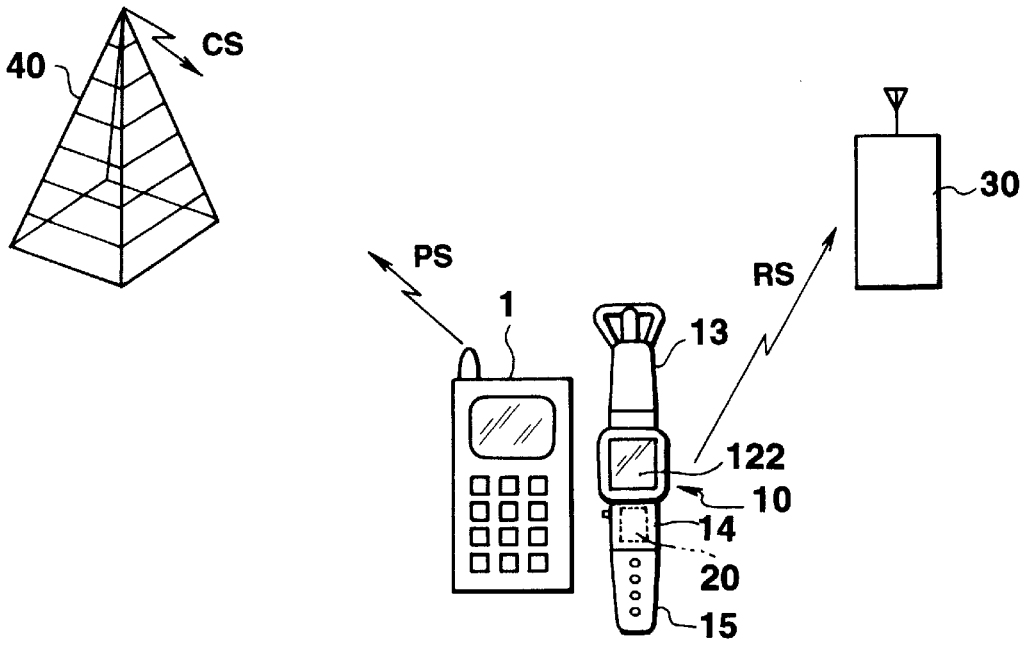
FIG. 10 illustrates a whole composition of a wireless telephone system as a third embodiment of the present invention.

While in the last-mentioned embodiment the signal reception detecting device 20 is formed as a unit, and the signal reception reporting device 30 is provided within the intervening member 14 of the wristwatch 10, reverse arrangement may be employed as shown in a third embodiment of FIG. 10 where a signal reception reporting device 30 is formed as a unit whereas a signal reception detecting device 20 is provided within an intervening member 14 of a wristwatch 10.

Figure 11:
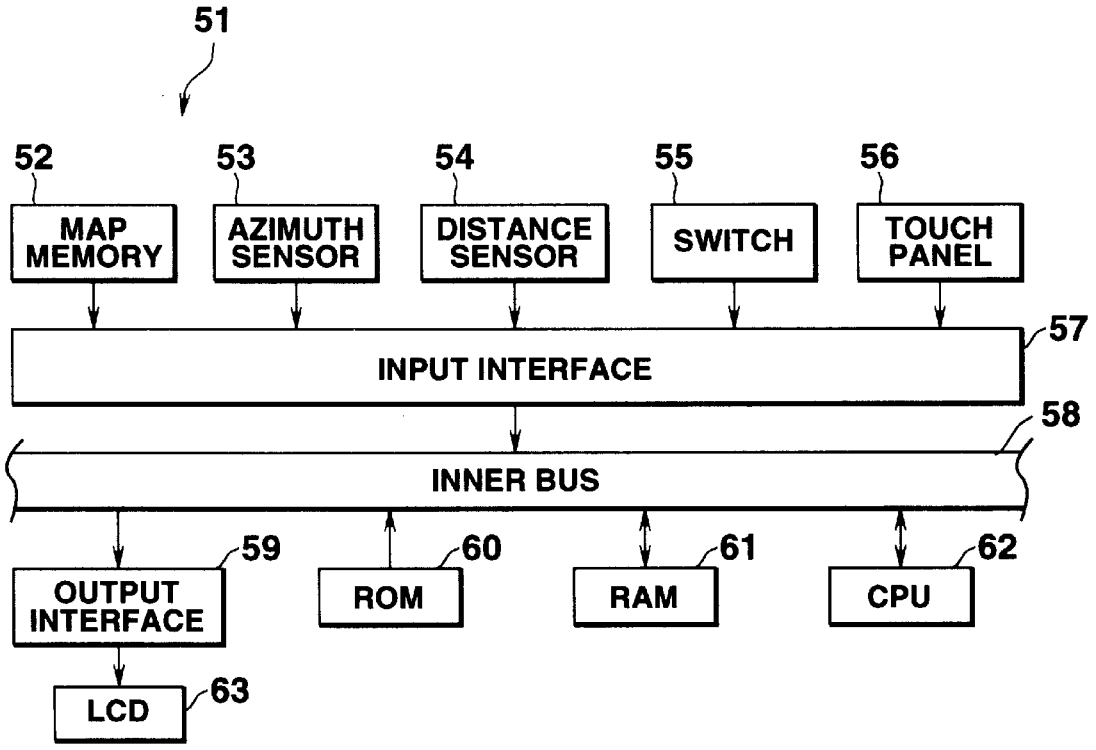
FIG. 11 is a block diagram of a navigation device used in a fourth embodiment of the present invention.

The device provided within the intervening member 14 is not limited to a device related to the personal telephone 1 such as the signal arrival detecting/reporting device 50, signal reception reporting device 20 or signal reception detecting device 30 illustrated in the above respective embodiments, but may be another electronic device such as a navigation device 51 as a fourth embodiment of FIG. 11.

The navigation device 51 includes a map memory 52, an azimuth sensor 53, a distance sensor 54, a switch 55, a touch panel 56, an input interface 57, an internal bus 58, an output interface 59, a ROM 60, a RAM 61, a CPU 62 and a LCD 63.

Map data about any particular area is read out as requested from the map memory 52 and displayed on the LCD 63. The azimuth sensor 53 senses terrestrial magnetism to generate azimuth data. The distance sensor 54 generates distance data at intervals of a unit distance. The switch 55 and touch panel 56 are operated by the user to input data on a destination/enlargement of the map to the RAM 61 when the navigation starts.

The touch panel 56 is laminated on the LCD 63, and when a particular one of divided touch areas is touched, generates a corresponding signal.

The input interface 57 is a signal converter for sending an input from each of the sensors, memories and switches to the internal bas 58.

The ROM 60 contains programs for inputting/outputting/processing various data via the input interface 57, output interface 59 and internal bus 58. Thus, the CPU 62 executes those programs to calculate a distance through which the telephone has moved from its starting point, its moving direction, and the present place and displays them together on a map which is displayed on the LCD 63.

Figure 12A:
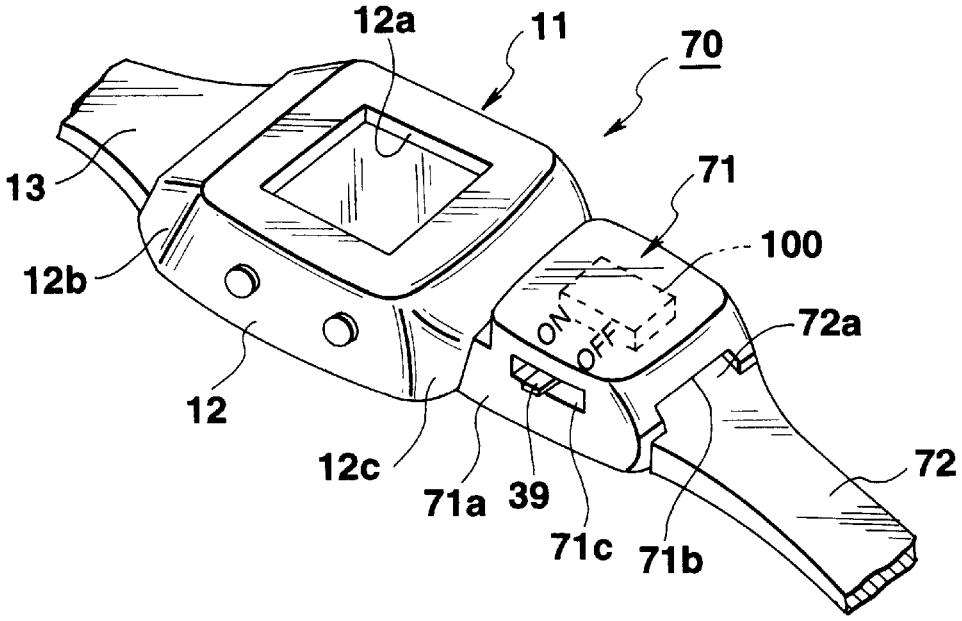
FIG. 12A is a perspective view of a wristwatch as a fifth embodiment of the present invention.
Figure 12B:
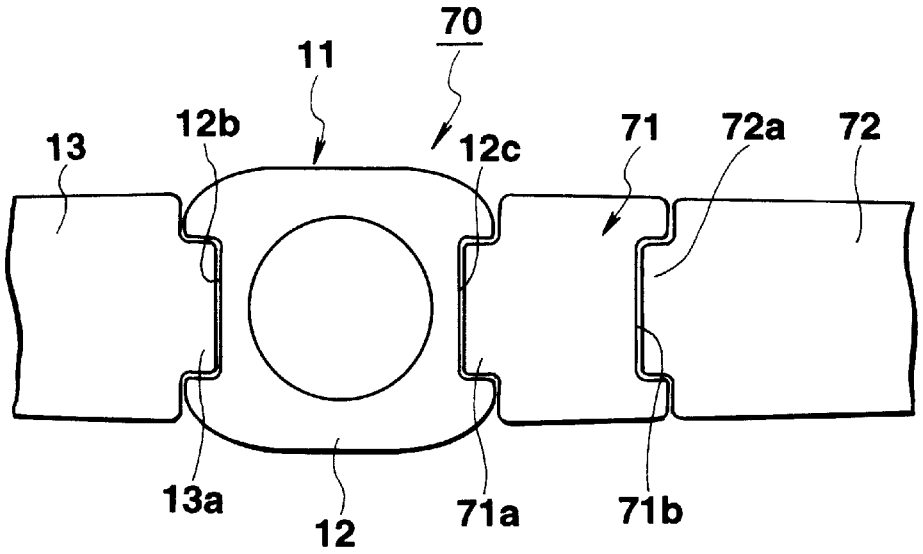
FIG. 12B is a back view of the wristwatch of FIG. 12A.

The LCD 63 and the touch panel 56 laminated on the LCD 63 may be disposed on a surface of the intervening member 14 or on the display window 12*a* of the watch body 11 to be used together with a display of time by the watch body 11. A wristwatch 70 as a fifth embodiment of the present invention is shown in FIGS. 12A and 12B. In the wristwatch 70, the watch body 11 and one band 13 are the same in composition as the corresponding ones of FIG. 2. More particularly, the watch body 11 contains a timer mechanism within the case 12, which has a display window 12*a* on its upper surface.

The case 12 has at lower portions of opposite sides corresponding concave engaging ends 12*b* and 12*c* which are engaged by a convex engaging end 13*a* of a band 13 and an intervening member 71, respectively.

The intervening member 71 is hollow and substantially rectangular in a plan view, and has substantially the same thickness as the watch body 11. The intervening member 71 has at a lower end of its watch side a convex engaging end 71*a* which has the same structure as a convex engaging end 72*a* of the other band 72. The intervening member 71 also has at a lower end of its other band side a concave engaging end 71*b*which has the same structure as a concave engaging end 12*c* of the case 12.

A horizontal slit 71*c* is provided on a side of the intervening member 71.

The other band 72 is engaged with the other concave engaging end 12*c* of the case 12 through the concave engaging end 12*c* of the intervening member 71. The intervening member 71 contains a predetermined electronic device 100 such as the signal reception detecting/reporting device 50 or signal reception reporting device 30 with the on/off switch 37 protruding through the slit 71*c* to the outside.

The other band 72 is engaged at its convex end 72*a* with the concave engaging end 71*b* of the intervening member 71 to be connected to the watch body 11.

As described above, in this embodiment, the intervening member 71 has the convex engaging end 71*a* which has the same structure as the convex engaging end 72*a* of the other band 72, and the concave engaging end 71*b* which has the same structure as the concave engaging end 12*c* of the case 12.

Thus, the conventional wristwatch which includes the pair of bands 13 and 72 and the watch body 11 may be changed such that only the other band 72 is removed, and the intervening member 71 is engaged with the watch body 11 and the other band 72. Thus, without changing the watch body 11 and the pair of bands 13 and 72 in design, the function of the electronic device 100 contained in the intervening member 71 may be added to the conventional wristwatch.

Figure 13A:
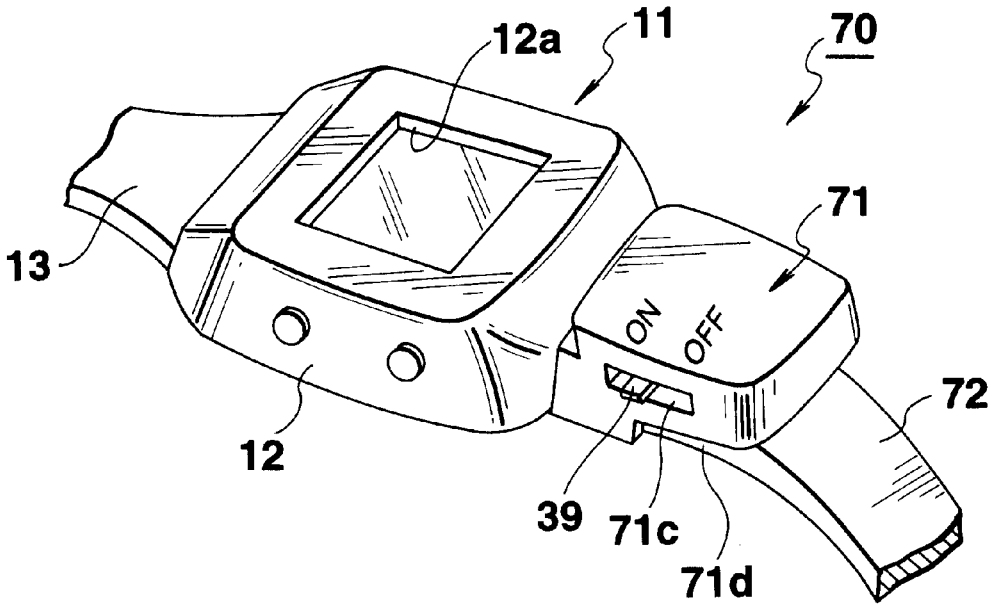
FIG. 13A is a perspective view of a wristwatch as a sixth embodiment of the present invention.

FIGS. 13A and B show a wristwatch 70 as a sixth embodiment of the present invention. In this embodiment, the intervening member 71 has a step 71*b* whose vertical side is formed so s to include a concave engaging end 71*b*. The other remaining structural portions of this embodiment are similar to the corresponding ones of the embodiment of FIG. 12.

In this embodiment, an engaging end of the other band 72 is shifted by the length of a horizontal flat of the step 71*d*, L, toward the watch body 11. Thus, when the intervening member 71 is provided in the wristwatch which includes the pair of bands 13 and 72 and the watch body 11, occurrence of a trouble in which the other band 72 will become uselessly long is avoided.

Figure 14A:
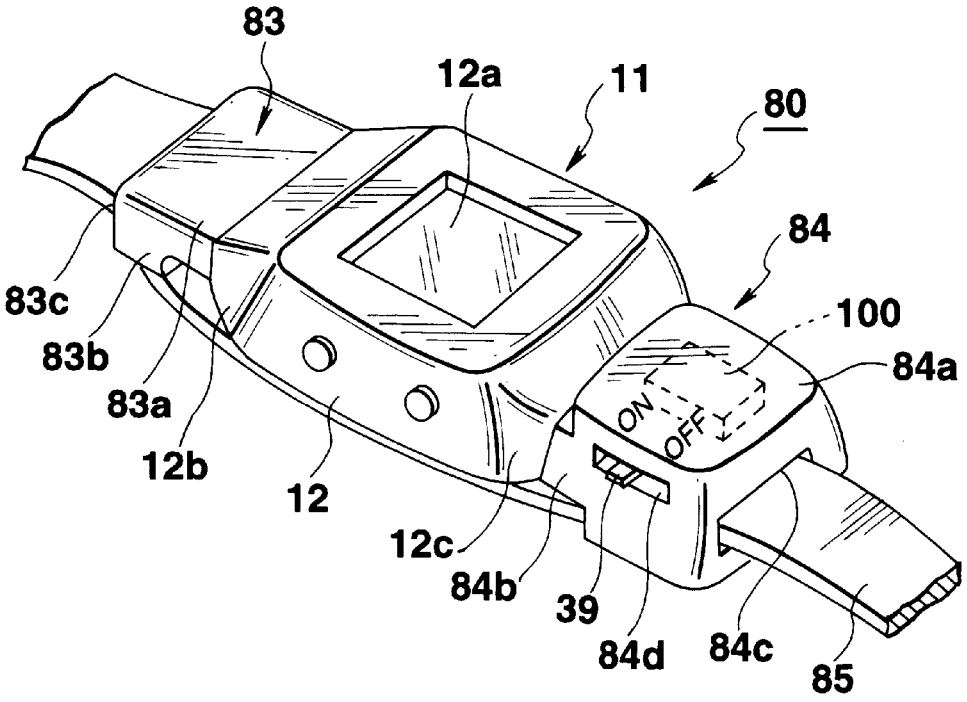
FIG. 14A is a perspective view of a wristwatch as a seventh embodiment of the present invention.
Figure 14B:
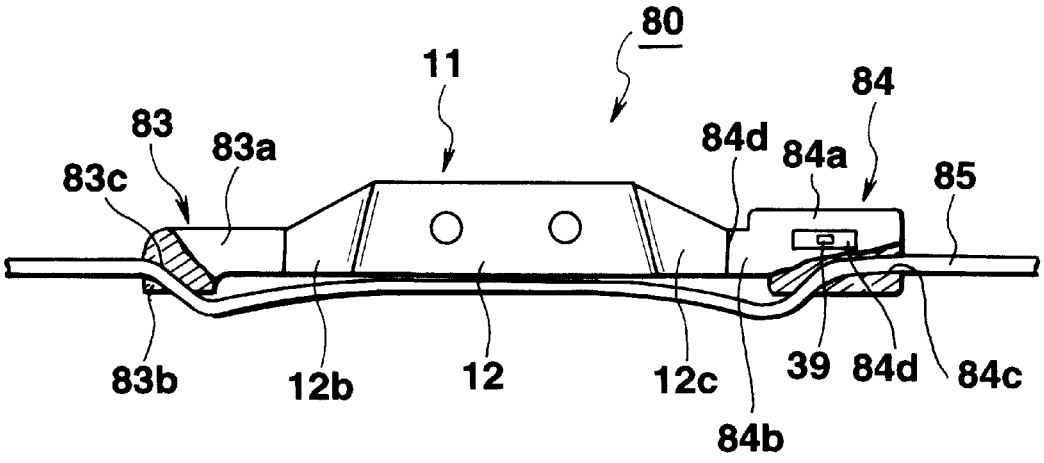
FIG. 14B is a front view of the wristwatch of FIG. 14A.

FIGS. 14A and B show a wristwatch 80 as a seventh embodiment of the present invention. In this wristwatch 80, the watch body 11 is the same in structure as that of FIG. 2 in which the watch body 11 is engaged at opposite concave engaging ends 12*b* and 12*c* with intervening members 83 and 84, respectively.

The intervening member 83 has a horizontal extending portion 83*a* with a vertically downward lug 83*b*. The intervening member 83 has a through hole 83*c* which extends through the end of the vertical lug 83*b* and the left end of the horizontally extending portion 83*a* thereof through which hole the band 85 extends.

The other intervening member 84 has a substantially rectangular hollow body 84*a* which has a convex engaging end 84*b* with a through hole 84*c* extending through the bottom and right end thereof through which hole the band 85 extends. The hollow body 84*a* contains an electronic device 100 such as the signal reception detecting/reporting device 50 or signal reception reporting device 30 with an on/off switch 39 of the electronic device 100 protruding through a slit 84*d* on a side of the hollow body 84*a* to the outside.

The band 85 is disposed on the back of the case 12 and extends through the through holes 83*c* and 84*c* in the intervening members 83 and 84.

According to this embodiment, the structure for combining the band 85 to the intervening members 83 and 84 is simplified, the whole structure of the wristwatch is simplified and the wristwatch is improved so as not to malfunction.

While in the particular embodiment the electronic device 100 is illustrated as contained only in one intervening member 84, the other intervening member 84 may also have a hollow body which contains an electronic device 100.

In summary, the first-seventh embodiments have the following corresponding compositions:

As shown in FIGS.1, 2A, 2B, 6, 10, 12A, 12B, 14A, 14B, the portable device (wristwatch 10, 70, 80) includes a wristwatch body (10) carried about by a user. The portable device comprises: putting-on means (bands 13, 15, 72) for putting the wristwatch body on the user; an intervening member (14, 71) for engaging the putting-on means with the wristwatch body; and function realizing means (signal reception reporting device 50, 30; electronic device 100) provided in the intervening member for realizing a predetermined function.

As shown in FIGS. 12A, B, the portable device (wristwatch 70) having a wristwatch body (10) carried about by a user comprises: an intervening member (71); function realizing means (signal reception reporting device 50, 30; electronic device 100) provided in the intervening member for realizing a predetermined function; and the intervening member comprises at one end engaging means (convex engaging end 13*a*) engaged with the wristwatch body (11) and at the other end engaging means (convex engaging end 72*a*) engaged with the putting-on means (band 72) for putting the watch body on the user.

As shown in FIG. 11, the function realizing means comprises self-position detecting means (navigation device 51) for detecting the position thereof.

As shown in FIG. 11, the portable device further comprises display means (LCD 63) provided in said intervening member required for realizing a function by the function realizing means.

As shown in FIGS. 12A, B, the putting-on means comprises a band (13, 72) for putting the wristwatch body (11) on a wrist of the user and each comprising engaging means (12*b*) for engaging with the wristwatch body.

The intervening member (71) comprises at one end engaging means (14*c*) for engaging with said wristwatch body and at the other end engaged means (72*a*) with which the engaging means of said band is engageable.

As shown in FIGS. 13A, B, the putting-on means comprises a band (13, 72) for putting said wristwatch body on a wrist of the user's wrist.

The intervening member (71) comprises at one end engaging means (71*a*) for engaging with the wristwatch body and engaging means for engaging with one of the band (72) at a position closer to the one end than to the other end thereof.

As shown in FIGS. 14A, B, the putting-on means comprises a band (85) for putting the watch body (11) on a wrist of the user. The portable device comprises: a pair of said intervening members (83, 84) provided each at a respective one of opposite ends of said wristwatch, at least one of the pair of intervening members containing the function realizing means (100), and the bands extending through the pair of intervening members.

As shown in FIGS. 14A, B, intervening member comprises a pair of intervening members (83, 84) which each comprises at one end engaging means (12*b*, 12*c*) for engaging with the watch body (11) and at the other end a through hole (83*c*, 84*c*) through which a band (85) extends which puts the watch body (11) on a wrist of the user; and at least one (84) of the pair of intervening members contains said function realizing means (100).

As shown in FIGS. 2A, B, the portable device comprises a body (watch body 11) in which a display unit (LCD 322) for displaying data is provided. The portable device also comprises: putting-on means (bands 13, 15) for putting said device body on a user; and a receiving unit (signal reception reporting device 50) provided on the putting-on means for receiving an external signal and for reporting to the user that there is a received external signal on the basis of the received external signal, the device body and the putting-on means are arranged on the same smooth surface (FIG. 2B) which is brought into contact with the user for putting the device body on the user.

As shown in FIGS. 2A, B; FIG. 11, the device body comprises at least one of a timepiece function unit (120) for displaying measured time data on the display unit (122) or a self-position detector (52 of FIG. 11) for displaying detected self-position data on the display unit.

As shown in FIGS. 2A, B, the putting-on member (15) comprises at one end an engaging end (14*c*) engaged removably with one end of a portable device body.

As shown in FIGS. 4A, 2A, 2B, the receiving unit (50) further comprises a timepiece function unit (26, 27) and the putting-on means comprise a wristband (13, 15).

According to the first-seventh embodiments, as described above, an increase in a whole thickness of a limited area which contains the intervening member of the wristwatch is avoided and hence occurrence of an undesirable trouble is avoided in which when the user wears the wristwatch, its intervening member would interfere in the user's daily action with another person or his or her belongings to hinder the person's behavior and hence the device contained in the intervening member would malfunction. In addition, giving a feeling of discomfort to the user when the wristwatch is worn around the user's wrist is avoided. A design which gives a feeling that the wristwatch body and the intervening member are formed as a unit is possible. In addition, the function of a device provided within the intervening member adds to the timepiece function while the degree of freedom of design is improved.

According to the first-seventh embodiments, a user's position detecting device excellent in portage is provided which can be worn around the user's wrist.

In addition, according to the first-seventh embodiments, since the display means provided in the intervening member displays the user's position, the user can easily confirm his or her position in a manner similar to that in which the user confirms time by wristwatch.

According to the first-seventh embodiments, since the intervening member is provided between the watch body and the band of the conventional wristwatch, the function of a device provided in the intervening member adds at low cost in the conventional wristwatch without changing its design.

According to the first-seventh embodiments, even then the conventional wristwatch is used, the intervening member prevents the band connected thereto from lengthening substantially. Thus, an increase in the cost of the wristwatch is suppressed, using the conventional wristwatch while a reduction in the handiness of the wristwatch which would otherwise occur due to lengthening of the band is prevented.

According to the first-seventh embodiments, since the band extends through the through hole provided in the intervening member, the connection between the band and the intervening member is simple, the cost required for this composition is low, an increase in the whole thickness of the wristwatch in the direction of its thickness is small. Thus, when worn, the wristwatch gives no feeling of discomfort to the user, and the degree of freedom of design remains high.

According to the first-seventh embodiments embodiments, an electronic device is provided in which an electronic device body and its putting-on members give no feeling of discomfort to the user when the electronic device is worn around the user's wrist and which has a function of reporting to the user reception or arrival of an external signal, if any. In addition, the electronic device may have the function of displaying time data and the user's position data.

According to the first-seventh embodiments, since the putting-on members and the receiving device are formed as a unit, the whole device becomes compact and reduced in cost.

A signal reception/reporting device as an eighth embodiment of the present invention will be described next with reference to a block diagram of FIG. 15. As shown, the signal reception reporting device comprises an antenna 110 which receives a response signal which the portable terminal or telephone 1 generates in response to reception or arrival of a signal at the terminal 1. The antenna 110 is connected to a radio wave detecting device 111, which detects a radio wave received by the antenna 110 to produce a signal of a predetermined signal reception pattern, which is then amplified by an amplifier 112 to such an extent that the amplified pattern signal is recognized by a controller 113 which comprises a CPU.

The controller 113 determines whether there is an input signal or a reception pattern signal and hence whether there is a received signal, and controls a driver 114 and a sounder 115 on the basis of the result of the determination. The driver 114 is connected to a first lamp 101*a* to an nth lamp 101*n*(n LEDs). The controller 113 contains a turning on/off pattern of the lamps 101*a*–101*n* and a sounding pattern produced by the sounder 114

Figure 13B:
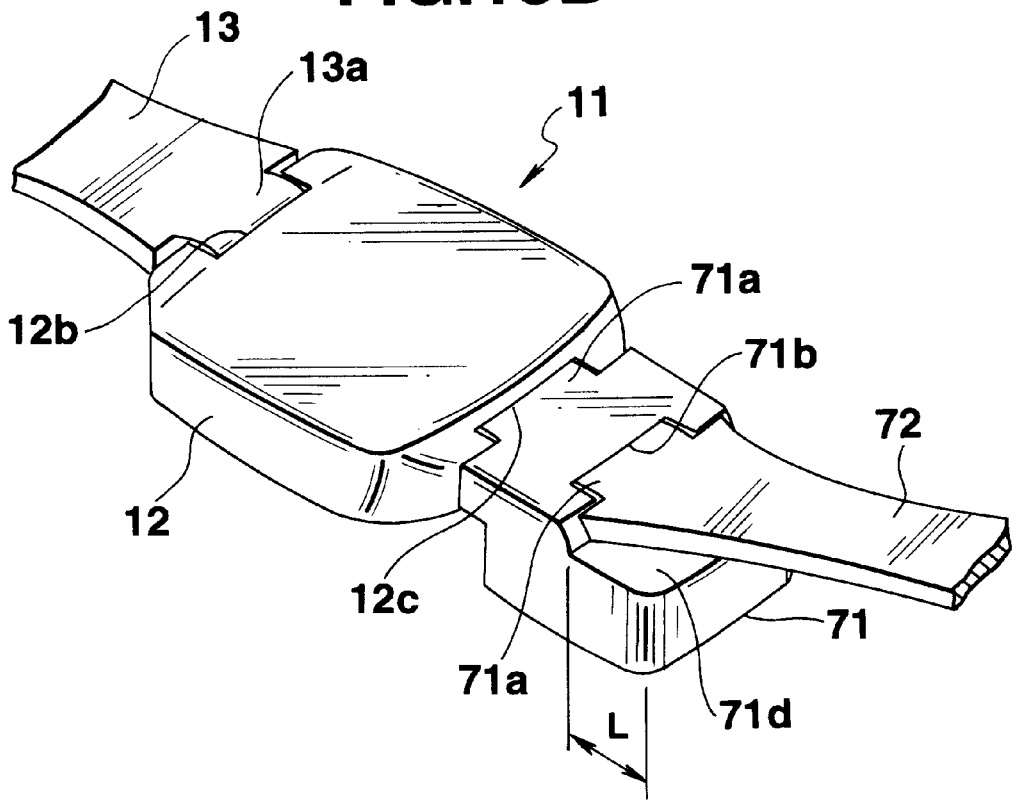
FIG. 13B is a back view of the wristwatch of FIG. 13A.
Figure 16:
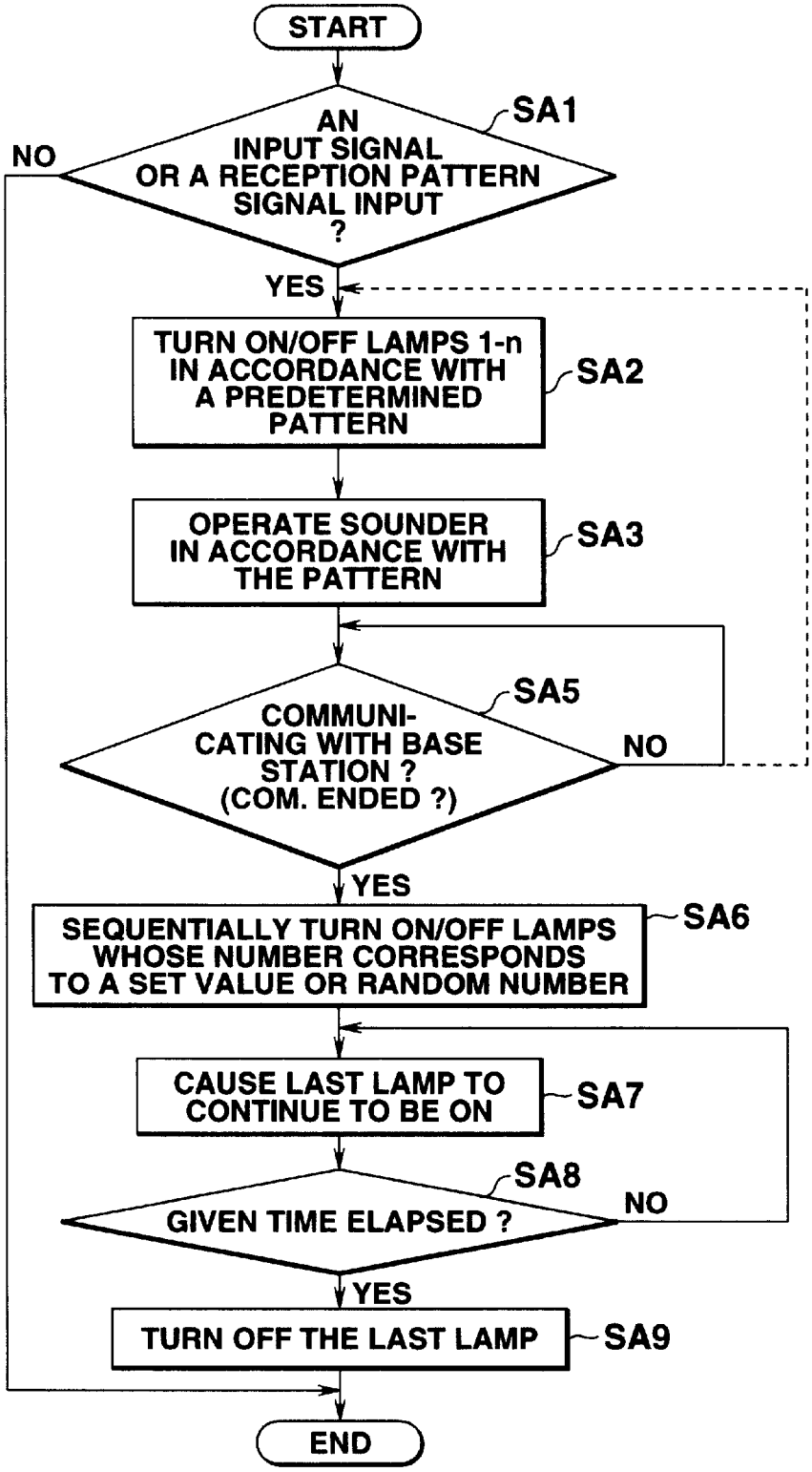
FIG. 16 is a flow chart of a process for controlling the reporting device of the embodiment of FIG. 15.
Figure 17A:
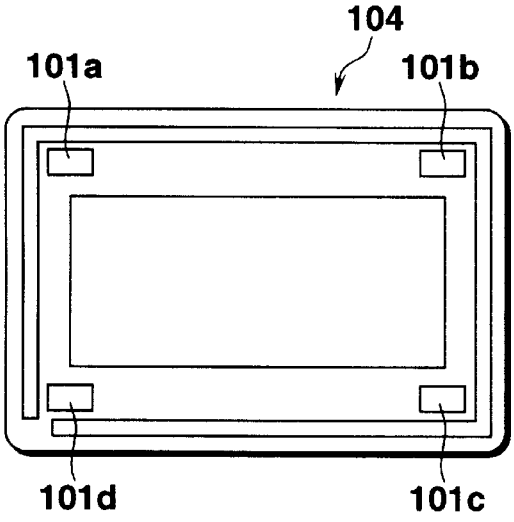
FIGS. 17A and B each show arrangement of lamps of the device of FIG. 16.

When the power supply is on in the particular embodiment, the controller 113 operates in accordance with a flow chart of FIG. 16 based on a relevant program, and determines whether there is an input signal or a reception pattern signal from the amplifier 112 (step SA1). When the terminal 1 generates a response signal in response to reception of a signal at the terminal 1, the response signal is received by the antenna 110, and hence the radio wave detecting device 111 generates a reception pattern signal, which is then input to the amplifier 112. The controller 113 then shifts its control from step SA1 to SA2, where it turns on/off the lamps 101*a*–101*n* in accordance with a stored predetermined pattern (step SA2). According to the predetermined pattern, for example, as shown in FIG. 17A, the lamps 101*a*, 101*b*, 101*c* and 101*d* arranged at the respective corners of the device 4 are sequentially turned on and off in this order so that a light spot moves along a path circulating along the periphery of a square. Alternatively, as shown in FIG. 13B, lamps 101*a*, 101*b*, 101*c* and 101*d* arranged on a straight line on the devices body 4 are turned on and off in this order so that a spot light moves along the straight line.

At step SA3, the controller 113 controls the sounder 115 in accordance with that pattern. For example, sounds of different pitches are produced synchronously with the turning on and off of the lamps 101*a*–101*d*. Thus, the turning on/off of the lamps in that pattern are sufficient to stimulate the eyesights of people around the user and sounds from the sounder 115 also are sufficient to stimulate the persons'auditory senses to thereby draw their attention securely to the turning-on/off lamps. Thus, the user will feel satisfactory.

The controller 113 operates at steps SA5–SA9 of a flow chart based on a relevant program. At step SA5 subsequent to step SA3, the controller 113 determines whether the terminal 1 is in communication with the base station or whether the user at the terminal 1 is in telephonic communication with its party through the base station. If so, the controller 113 waits for the termination of the communication. As shown in broken lines, as long as the user at the terminal 1 is in telephonic communication with the user's party, the controller 113 iterates the turning on/off of the lamps 101*a*–101*n*(step SA2) and control over the sounding operation (step SA3).

When the telephonic communication between the user at the terminal 1 and the user's party and hence the communication between the terminal 1 and the base station ends, the controller 113 outputs a predetermined set value, for example, corresponding to the length of the communication time or a random number, so that the lamps whose number corresponds to the output set value or random number are turned on/off (step SA6), and the last lamp continues to be on (step SA7).

Figure 17B:
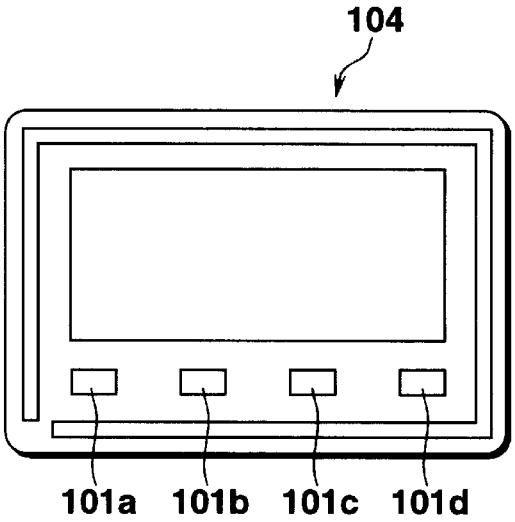

In summary, when the telephonic communication ends, the lamps whose number corresponds to the set value or random number are sequentially turned on/off. Thereafter, the last lamp (for example, 101*b* of FIG. 17 A) continues to be on.

Thus, the user's fortune at that time can be told from characters (for example, "BEST LUCK", "AVARAGE GOOD LUCK", "A LITTLE BETTER LUCK" or "BAD LUCK", etc.) printed on a indicator label (not shown) pasted on the device body corresponding to the lamp (for example, 101*b* in this case) which last continues to be on. When the last lamp has continued to be on for a predetermined time (step SA8), the lamp is turned off (step SA9) and the processing involving this flow chart end.

While in the embodiment the last lamp is automatically turned off after the predetermined time has elapsed, the lamp may be turned off by a manual switch. While in the particular embodiment the oracle is illustrated as consulted, another game such as a roulette or dice game can be played instead.

The arrangement of the lamps and the turning on/off pattern of the lamps are not limited to the ones described and illustrated above. Various other forms of arrangement of the lamps and the turning on/off pattern of the lamps may be employed, of course. In addition, a manual switch may also be provided for turning on/off the sounder 115 or the sounder 115 itself may be omitted.

Figure 18A:
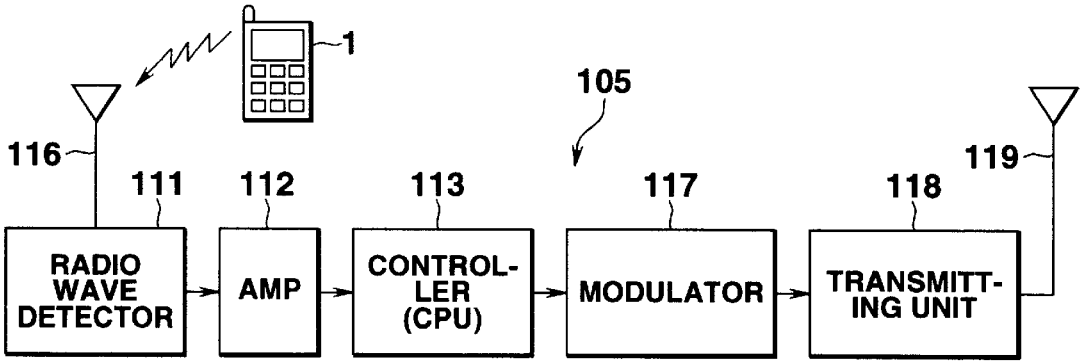
FIG. 18A is a block diagram of a signal reception detecting device of a ninth embodiment of the present invention.
Figure 18B:
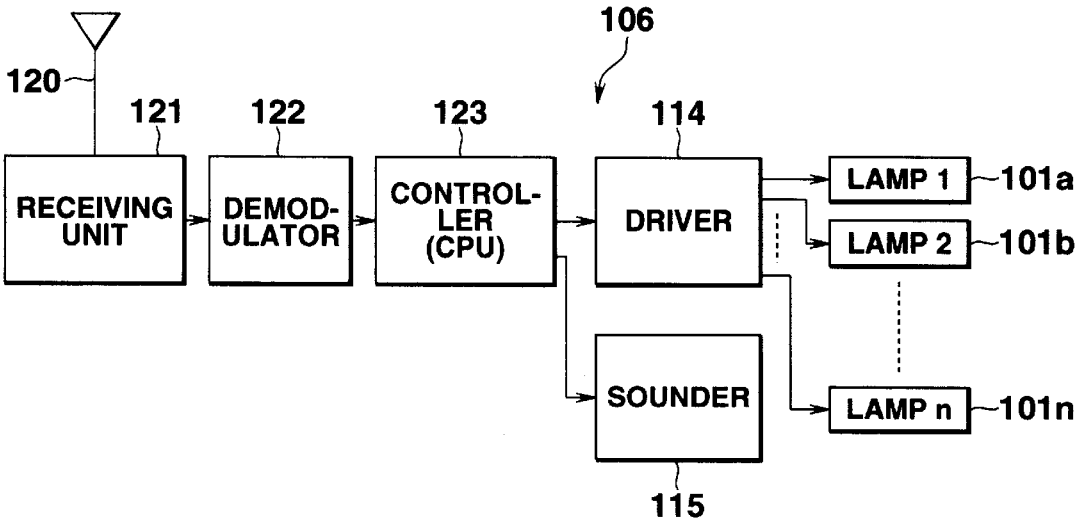
FIG. 18B is a block diagram of a signal reception reporting device of the ninth embodiment.

FIG. 18A and B show a ninth embodiment of the present invention related to a signal reception detecting device 105 and a signal reception reporting device 106. As shown in FIG. 18A, the signal reception detecting device 105 includes an antenna 116 which receives a response signal which is generated by a portable terminal 1 in response to reception of a signal at the terminal 1. The antenna 116 is connected to a radio wave detecting device 111, which detects a radio wave signal received by the antenna 116 to produce a predetermined reception pattern signal. An amplifier 112 amplifies the pattern signal to such a level to which a controller 113 which comprises a CPU can sufficiently recognize the signal. An output of the controller 113 is modulated by a modulator 117 and then sent by a transmitting unit 118 through a sending antenna 119. The signal reception reporting device 106 comprises a receiving unit 121 which receives a signal sent by the sending antenna 119 via a receiving antenna 120, and a demodulator 122 which demodulates the signal received by the receiving unit 121. The reporting device 106 also includes a controller (CPU) 123 which controls a driver 114 and a sounder 115 based on an output from the demodulator 122, and a plurality of lamps 101*a*–101*n* connected to the driver 114.

When the antenna 116 of the signal reception detecting device 105 receives a response signal from the portable terminal 1, the radio wave detecting device 111 generates a reception pattern signal which is then amplified by the amplifier 112, and the resulting signal is then input to the controller 113. The controller 113 controls the modulator 117 so that a modulated signal from the modulator 117 is sent via the transmitting unit 118 and the sending antenna 119 to the signal reception reporting device 106.

More particularly, the signal from the sending antenna 119 is received by the receiving antenna 120 of the signal reception reporting device 106, and then intercepted by the receiving unit 121. This signal is then demodulated by the demodulator 122 and input to the controller 123. In response, the controller 123 operates in accordance with a flow chart of FIG. 16. Thus, the lamps 101*a*–101*n* are turned on and off in a predetermined pattern and the sounder 115 is controlled in accordance with that pattern.

That is, in the particular embodiment, the signal reception detecting device 105 detects a response signal from the terminal and the signal reception reporting device 106 receives the radio waves from the signal reception detecting device 105 to control the lamps and sounding. Thus, the coverage of the signal reception reporting device 106 which detects the signal from the signal reception detecting device 105 can be set in a narrow range, for example, of 40–50 cm, depending on the output of the detecting device 105. Thus, even when there are several persons around the user, who each have a signal reception detecting device 105 and a signal reception reporting device 106, malfunction of the signal reception reporting devices 106 of those persons is prevented.

Figure 15:
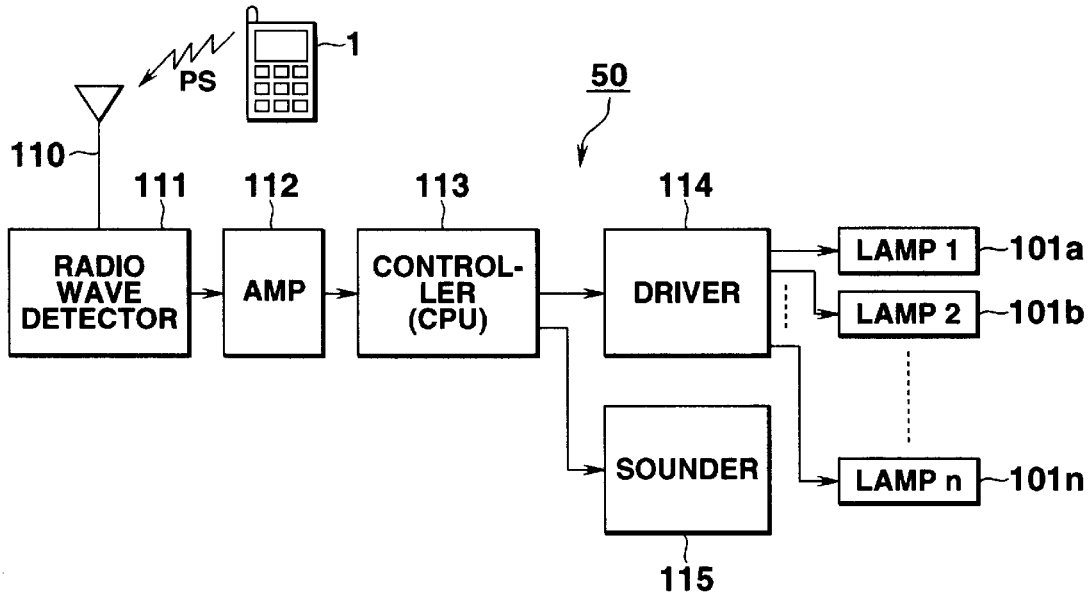
FIG. 15 is a block diagram of a signal reception reporting device as an eighth embodiment of the present invention.
Figure 19:
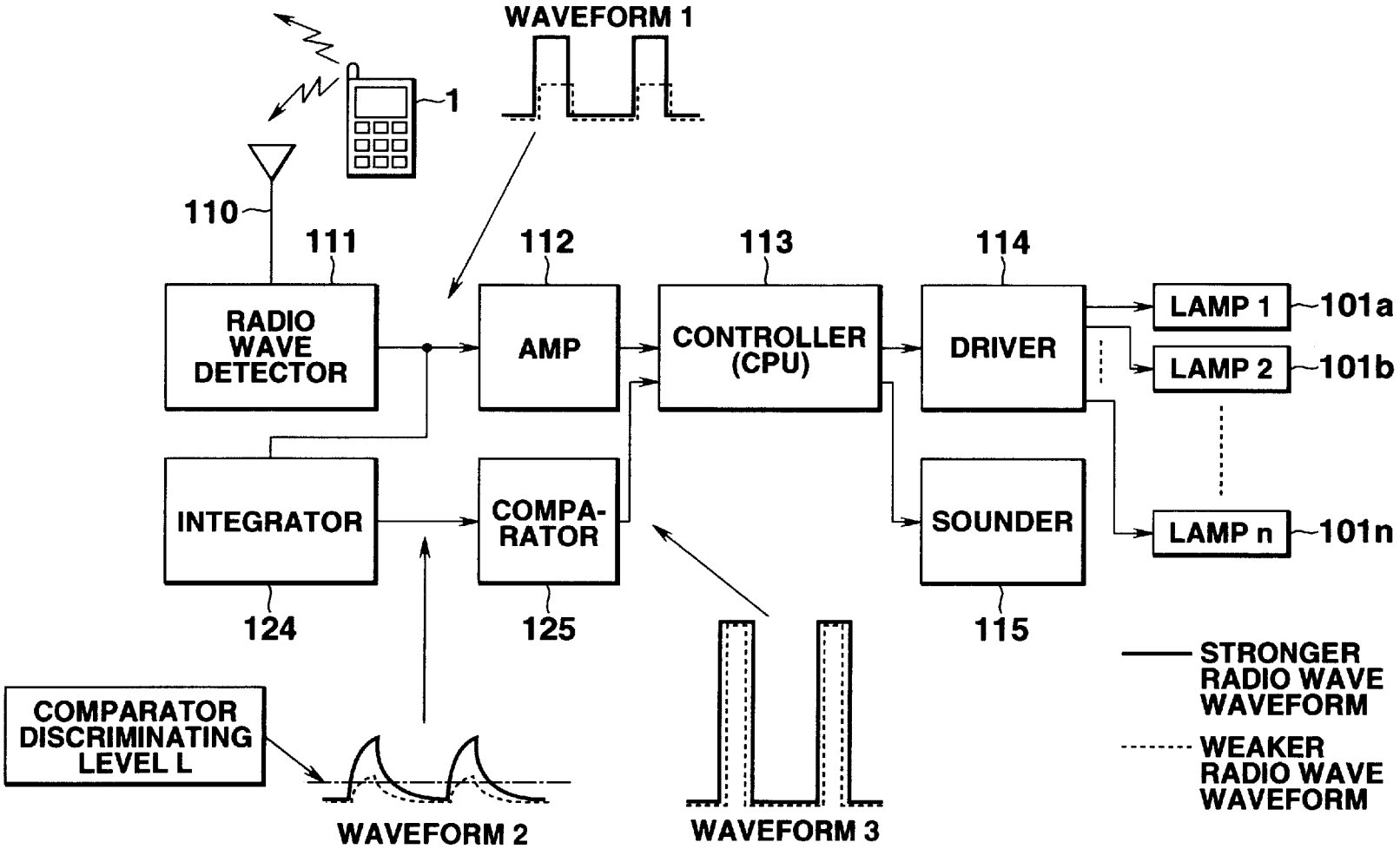
FIG. 19 is a block diagram of a signal reception reporting device as a tenth embodiment of the present invention.

FIG. 19 illustrates a signal reception reporting device as a tenth embodiment, and comprises an antenna 110, a radio wave detecting device 111, an amplifier 112, a controller 113, a driver 114 a plurality of lamps 101*a*–101*n*, and a sounder 115, as in the eighth embodiment of FIG. 15. The signal reception reporting device of the tenth embodiment further comprises an integrator 124 and a comparator 125 through which an output from the radio wave detecting device 111 is delivered to the controller 113.

When the radio wave detecting device 111 receives a response signal from a portable terminal 1 in this particular embodiment, the radio wave detecting device 111 generates a reception pattern signal of a waveform 1 whose height increases as the radio wave received by the antenna 110 increases, and the reception pattern signal is inputted to the amplifier 112 and the integrator 124. In response to this pattern signal, the integrator 124 integrates the reception pattern signal to form a substantially triangular waveform 2. The comparator 125 shapes only a waveform 2 whose height is higher than a predetermined comparator threshold L into a signal of a waveform 3 having a predetermined voltage level and a width which reflects the strength of the received radio wave. This signal is then output to the controller 113.

Figure 20:
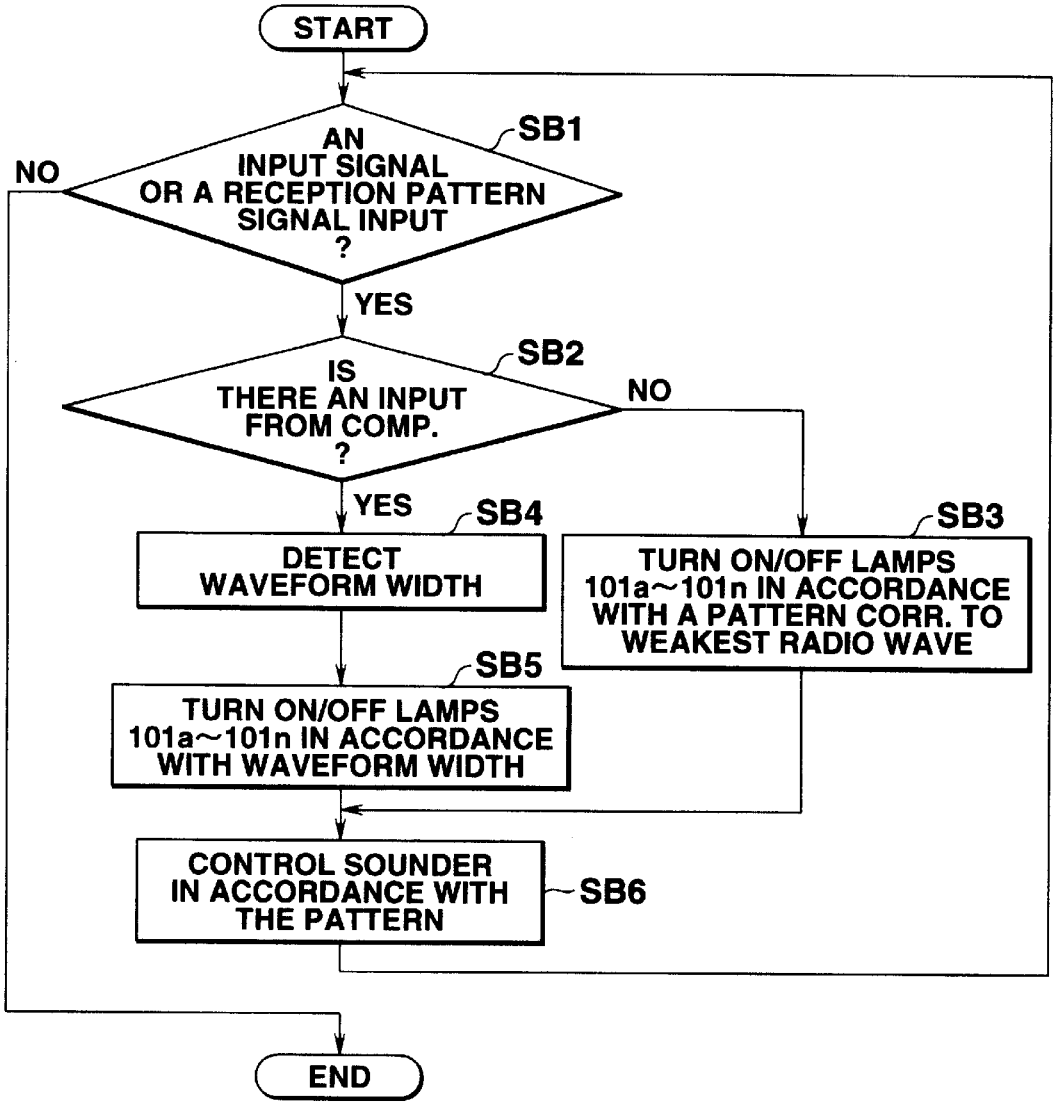
FIG. 20 is a flow chart of a process for controlling the reporting device of FIG. 9.

The controller 113 operates in accordance with a flow chart of FIG. 20 based on a relevant program. The controller 113 determines whether there is an input signal or a reception pattern signal from the amplifier 112 (step SB 1). When the radio wave detector 111 generates a reception pattern signal, and the controller 113 receives this pattern signal through the amplifier 112, the controller 113 then determines that there is an input from the comparator 125 (step SB 2).

At this time, the comparator 125 outputs a waveform 3 as described above, only when the crest value of the waveform 2 is above the predetermined comparator threshold L. Thus, when the received radio wave is weak and the crest value of the waveform 2 is lower than the comparator threshold L, as in the case where the device of FIG. 19 has received a response signal from a third party's terminal 1, the comparator 125 provides no output for the controller 113. Thus, in this case, the control ler 113 shifts its control from step SB 2 to SB 3, where the controller controls the lamp 101*a*–101*n* in accordance with a pattern corresponding to a weakest radio wave, so that, for example, only one lamp is turned on or off.

If there is an input from the comparator 125 as the result of the determination at step SB 2, however, the controller 113 detects its waveform width (step SB 4), turns on/off the lamps 101*a*–101*n* in a pattern corresponding to the detected waveform width different from the pattern corresponding to the weakest radio wave (step SB 5), and turns on/off lamps the number of which corresponds to the waveform width. At step S6 continuing from step SB 3 or SB 5, the controller 13 controls the sounder 115 in the same pattern as the turning-on/off pattern for the lamp 101*a*–101*n*.

Thus, in this embodiment, the strength of the received radio wave is indicated by the turning on/off of the lamps 101*a*–101*n*. Thus, by viewing the turning on/off display of the lamps, the user can discriminate between the case where the user has received a response signal from a third party's terminal 1 and the case where the user has received an appropriate response signal from the user's own terminal 1. In addition, the user can also know the strength of the received radio wave based on the turning on/off state of the lamps.

Figure 21:
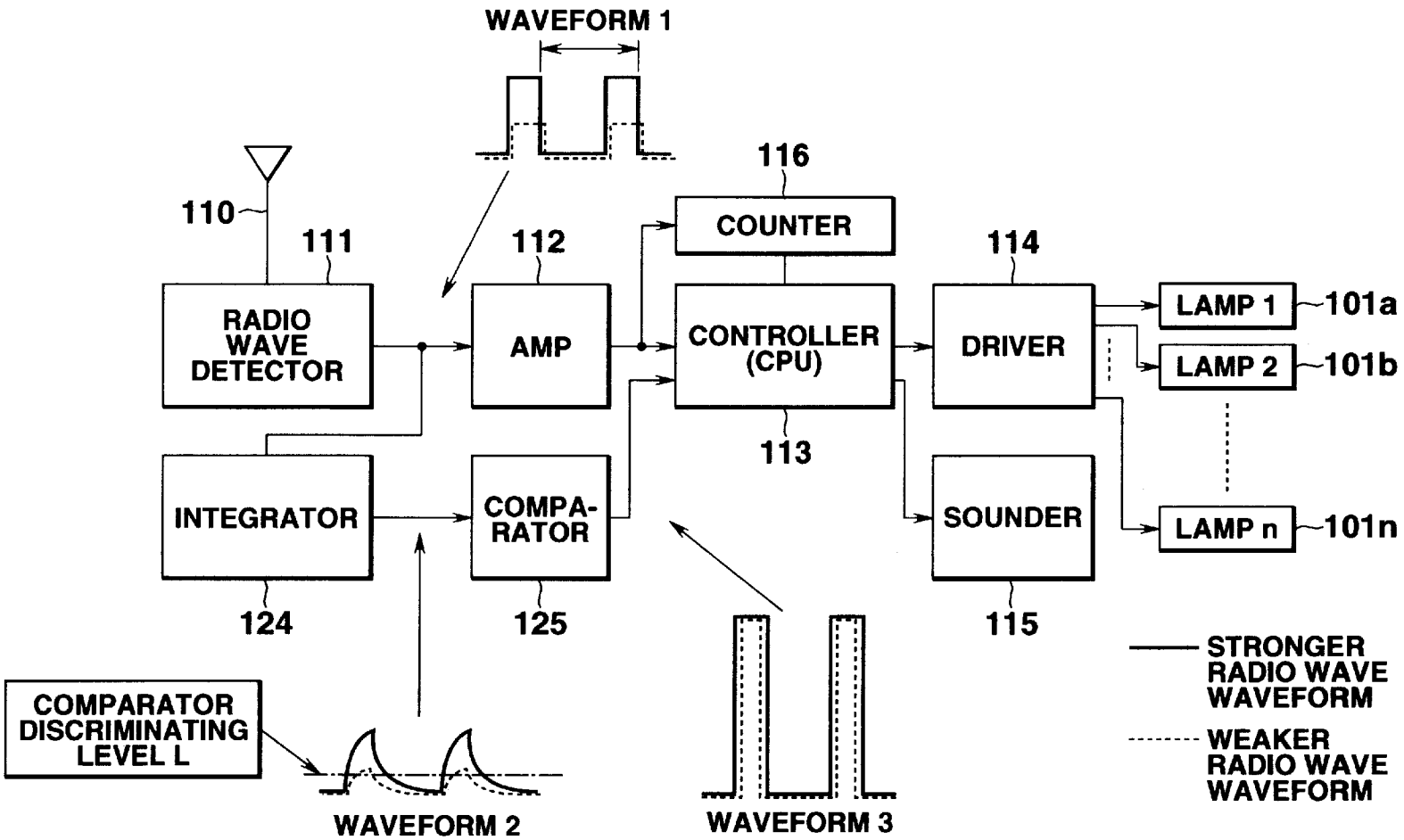
FIG. 21 is a block diagram of a signal reception detecting device as an eleventh embodiment of the present invention.

FIG. 21 shows a signal reception reporting device as an eleventh embodiment of the present invention directed to a combination of the embodiment of FIG. 19 and a counter 116. The counter 116 counts between 0 and 99 the number of waveforms 1 received from the radio wave detector 111 via the antenna 110 and the amplifier 112 during communication of the terminal 1 with the base station.

The period of the waveform 1 used for communication between the terminal 1 and the base station is 20 or 40 ms. Thus, the counter 126 changes a count between 0 and 99 at a rate of 25 or 50 per second or 1500 or 3000 per minute during communication.

Figure 22:
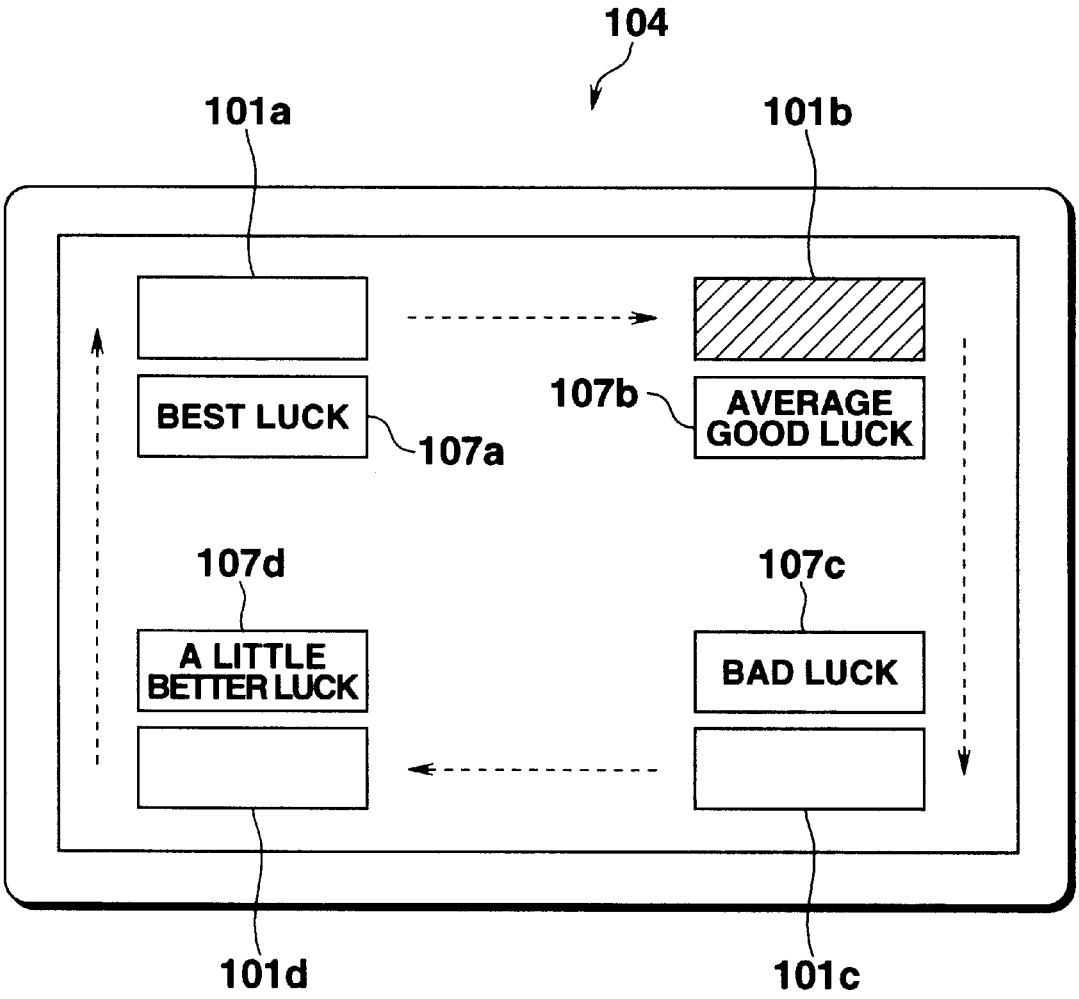
FIG. 22 is a plan view of a device body of the signal reception detecting device.

As shown in FIG. 22, the device body 104 has lamps 101*a*–101*d* corresponding nearby labels 107*a*–107*d* which have thereon prints "BEST LUCK", "AVERAGE GOOD LUCK", "BAD LUCK", and "A LITTLE BETTER LUCK" indicating the result of divination in printed oracles.

Figure 23:
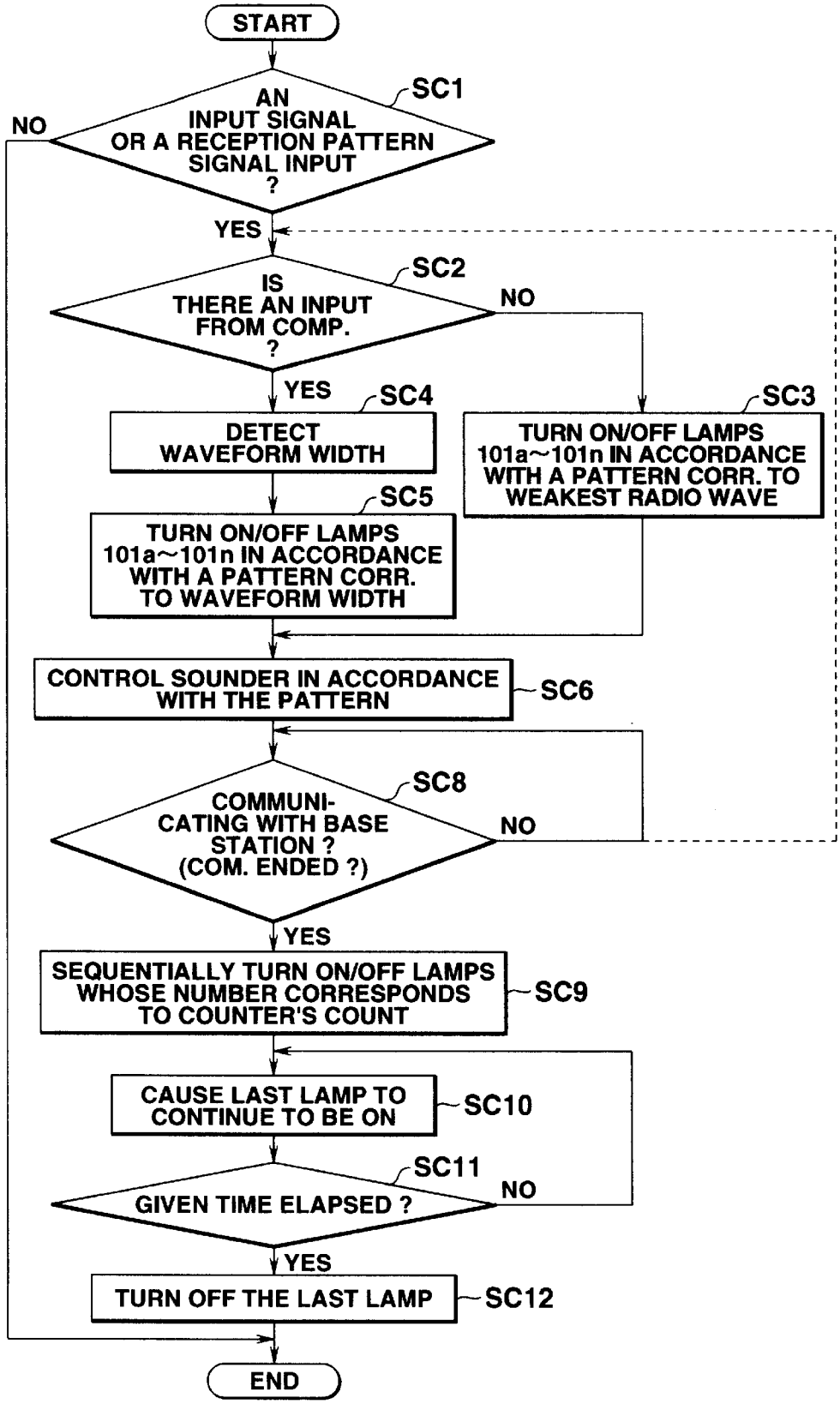
FIG. 23 is a flow chart of a process for controlling the signal reception detecting device of FIG. 22.

In this signal reception reporting device, the controller 113 operates in accordance with a flow chart of FIG. 23 based on a relevant program. In this flow chart, the processing at steps S1–S6 is the same as that at steps SB1–SB6 in the flow chart of FIG. 20. At step SC7, the controller 113 determines whether the user at the terminal is in (telephonic) communication with his or her party through the base station. If so, the controller 113 waits for termination of the communication (step SC8). As shown in broken lines in FIG. 22, as long as the communication continues, the controller 113 iterates the turning on/off of the respective lamps 101*a*–101*n* (step SC5) and the sounding operation (step SC6).

During this operation, the counter 116 counts up between 0 and 99 at a rate of 25 or 50 times per second or 1500 or 3000 times per minute. When the user's telephonic communication with his or her party, and hence the communication between the terminal 1 and the base station ends, the counter 116 stops at a count in a count range of 0–99 depending on the length of the duration time required for the communication. The controller 113 then reads the count in the counter 116, sequentially turns on/off lamps the number of which corresponds to the count (step SC9), and causes the last lamp (for example, 101*b*) to continue to be on (step SC10).

Thus, the user's fortune can be told from printed divination characters on an appropriate one of the labels 107*a*–107*d* stuck on the device body 104 in the vicinity of the lamp 101*b* which is last turned on and continues to be on (in the case of FIG. 22, "AVERAGE GOOD LUCK"). After the last lamp has continued to be on for a predetermined time (step SC 11), the controller 113 turns off the lamp to thereby terminate this processing.

While in the particular embodiment the last lamp is automatically turned off when the predetermined time has elapsed, the lamp may be turned off by a manual switch. While in the particular embodiment, divination is illustrated in a printed oracle, the present invention is not limited to this particular case. For example, other games such as roulette or a dice game may be played.

Arrangement of the lamps and the turning on/off pattern of the lamps is not limited to that of the particular embodiment mentioned above. Various other arrangements of lamps and other turning on/off patterns of the lamps may be employed, of course. A manual switch may be provided to turn on and off the sounder 115 to control its sounding. Alternatively, the sounder 115 may be eliminated.

In summary, the eighth to eleventh embodiments have the following corresponding compositions, respectively:

As shown in FIGS. 15, 16, 17A, B, the portable device (50) includes detecting means (radio wave detector 111-CPU 113) for detecting reception of a signal at a portable terminal (1). The portable device comprises: a plurality of turnable-on/off light emitters (lamps 101*a*–101*n*); controls means (CPU 113; SA 2), responsive to said detecting means (radio wave detector 111-CPU 113) detecting reception of a signal at a portable terminal (1), for turning on/off the plurality of light emitters in accordance with a predetermined pattern to report the reception of the signal to the user.

As shown in FIGS. 18A, B, the portable device (106) includes receiving means (receiving antenna 120) for receiving a predetermined signal from sending means (sending antenna 119) which detects reception of a signal at a portable terminal (1) and which sends the predetermined signal. The portable device comprises: a plurality of turnable-on/off light emitters (lamps 101*a*–101*n*); controls means (CPU 123) for turning on/off said plurality of light emitters based on the predetermined signal received by said receiving means in accordance with a predetermined pattern to report the reception of the signal to the user.

As shown in FIGS. 19, 20, the portable device includes detecting means (radio wave detector 111) for detecting a response signal from a portable terminal (1). The portable device comprises: determining means (CPU 113; comparator 125) for determining the strength of the response signal detected by the detecting means; a plurality of turnable-on/off light emitters (lamps 101*a*–101*n*); controls means (CPU 113; SB3) for turning on/off the plurality of light emitters base on a result of the determination by the determining means in accordance with a predetermined pattern to report the reception of the signal to the user.

As shown in FIG. 21, The determining means comprises: signal generating means (125) for generating a signal representing a width of a waveform depending on the strength of the response signal; and judging means (113) for judging the strength of the response signal based on the width of the waveform of the signal generated by the signal generating means.

As shown in FIG. 21, the determining means comprises: integrating means (124) for integrating the waveform of the response signal; waveform shaping means (125) for shaping the waveform integrated by said integrating means; and judging means (113) for determining the strength of the response signal based on the width of the waveform shaped by the waveform shaping means.

As shown in FIGS. 16, 23, the control means further turns on/off the plurality of light emitters in response to the end of communication (SA5; SC 8) of the portable terminal.

As shown in FIGS. 16, 23, the control means randomly determines one of the plurality of light emitters to be last turned on (SAG, SA7, SC 9, SC 10).

As shown in FIGS. 16, 23, the control means controls the light emitter to be last turned on so as to have a light emitting form different from that represented by the pattern (SC 10; continuous lighting).

As shown in FIG. 22, the plurality of light emitters (101*a*–101*d*) have a corresponding plurality of indicators (107*a*–107*d*) each representing a predetermined sense of play.

As shown in FIGS. 18A, B, The transmission/reception system includes a transmitter (transmitting unit 118; a signal reception detecting device 105) for detecting a response signal from a portable terminal (1) and for transmitting a predetermined signal, and a receiver (receiving unit 121; signal reception reporting device 106) for receiving the response signal from the transmitter, wherein the receiver comprises: a plurality of turnable-on/off light emitters (lamps 101*a*–101*n*); and control means (CPU 123) for turning on/off said plurality of light emitters based on the received signal in accordance with a predetermined pattern and for reporting reception of the signal to the user.

As described above, according to the eighth to eleventh embodiments, the light emitters 101*a*–101*n* are controlled so as to turn on and off in a predetermined pattern in response to detection of a received signal at the terminal 1. Thus, the turning on/off of the light emitters sufficiently stimulates the eyesights of persons around the user to draw the persons' attention securely to the turning on/off of the light emitters. Thus, the user feels satisfactory.

According to the eighth to eleventh embodiments, a predetermined signal is sent by the transmitting unit 118 in response to detection of reception or arrival of a signal at the portable terminal 1. When the predetermined signal is received by the signal reception reporting device, the controller turns on and off a plurality of light emitters 10*a*–101*n*. Thus, an area in which a signal is received or detected is set in a narrow range of distances. Thus, even when there are other persons who have similar signal reception reporting devices around the user, interference of the user's terminal with their signal reception reporting devices and hence their malfunction is prevented.

According to the eighth to eleventh embodiments, the strength of the response signal of the terminal 1 in response to signal reception or arrival at the terminal is determined, and the plurality of light emitters 101*a*–101*n* are turned on/off depending on the result of the determination. Thus, interception of a response signal from the user's own terminal 1 is clearly discriminated from interception of a response signal from a third party's terminal 1.

According to the eighth to eleventh embodiments, the strength of a response signal from the terminal 1 is determined based on a signal of a waveform width depending on the strength of the response signal from the portable terminal 1. Thus, the strength of the response signal is accurately determined, so that the light emitters are controlled accurately depending on the strength of the response signal from the terminal 1.

According to the eighth to eleventh embodiments, the light emitters 101*a*–101*n* are tuned on/off in response to the termination of (telephonic) communication between the terminal 1 and the base station. Thus, not only when a signal is received, but also (telephonic) communication between the user and the user's party is terminated, light emitted by the light emitters stimulates the eyesights of persons around the user to thereby draw their attention securely to the user's device.

According to the eighth to eleventh embodiments, the last one of the plurality of light emitters which are turned on and off is determined, for example, depending on the length of the duration time of the telephonic communication. Thus, a function of playing a divination game involving the last turned-on light emitter may be added to the device.

According to the eighth to eleventh embodiments, the last turned-on light emitter is controlled so as to emit light in a different manner from those in which the other remaining turned on/off light emitters emit light. Thus, the last turned-on light emitter is clearly recognized, so that when a game playing function is provided additionally, the result of a game to be played is clearly displayed According to the eighth to eleventh embodiments, the plurality of light emitters have the corresponding plurality of indicators (labels) each expressing a respective predetermined sense of play. Thus, each indicator and a corresponding light emitter can be selected as a last combination selected, for example, depending on the length of time required for the telephonic communication, and hence an interesting game can be played. Therefore, the value of the device as a commodity is enhanced.

Figure 24A:
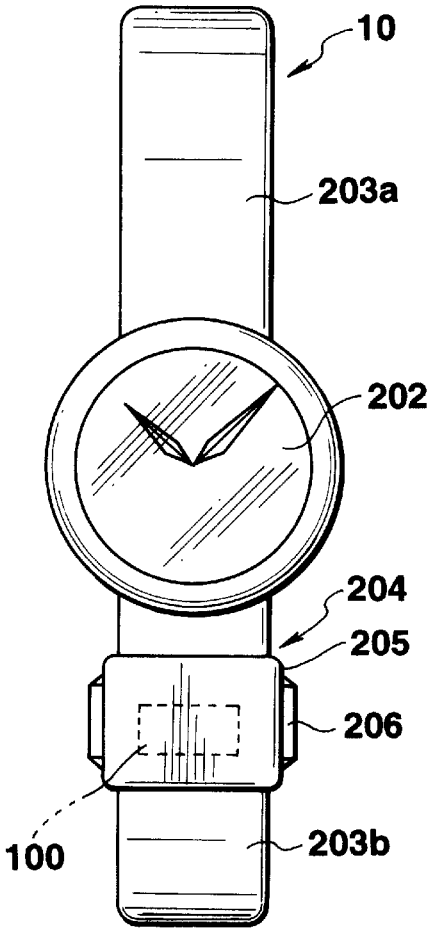
FIG. 24A is a front view of a wristwatch which includes an additional device as a twelfth embodiment of the present invention.
Figure 24B:
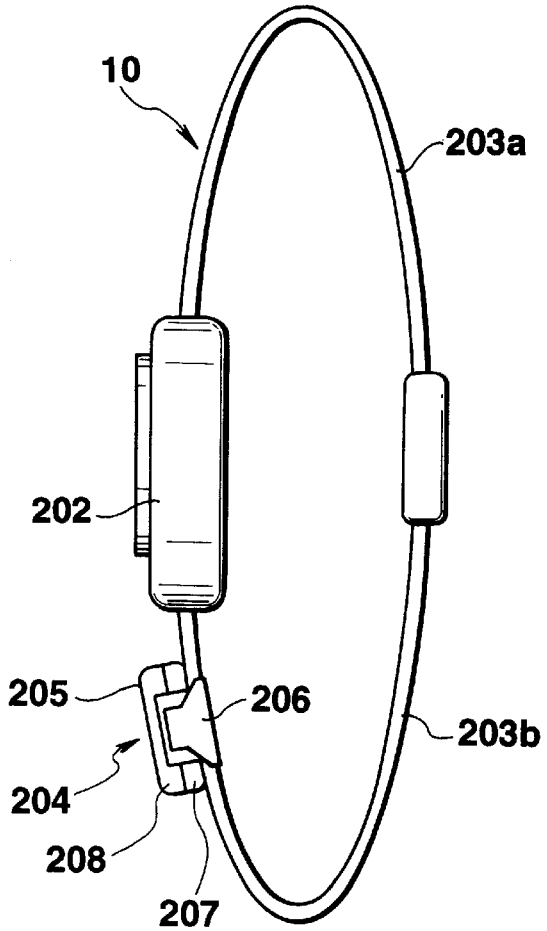
FIG. 24B is a side view of the wristwatch of FIG. 24A.

A wristwatch as a twelfth embodiment of the present invention will be described next with reference to the accompanying drawing. As shown in FIGS. 24A and B, the wristwatch 10 includes a watch body 202, bands 203*a* and 203*b* engaged at opposite ends with the watch body 202, and an additional device 204 attached to the band 203*b*.

The additional device 4 includes a case 205 which contains a signal reception detecting/reporting device 100 which detects and reports reception of a signal at a portable telephone 1, and a connector 206 engaged at opposite ends with the case 205, which includes a lower subcase 207 and an upper subcase 208 fitting to the lower subcase.

Figure 25:
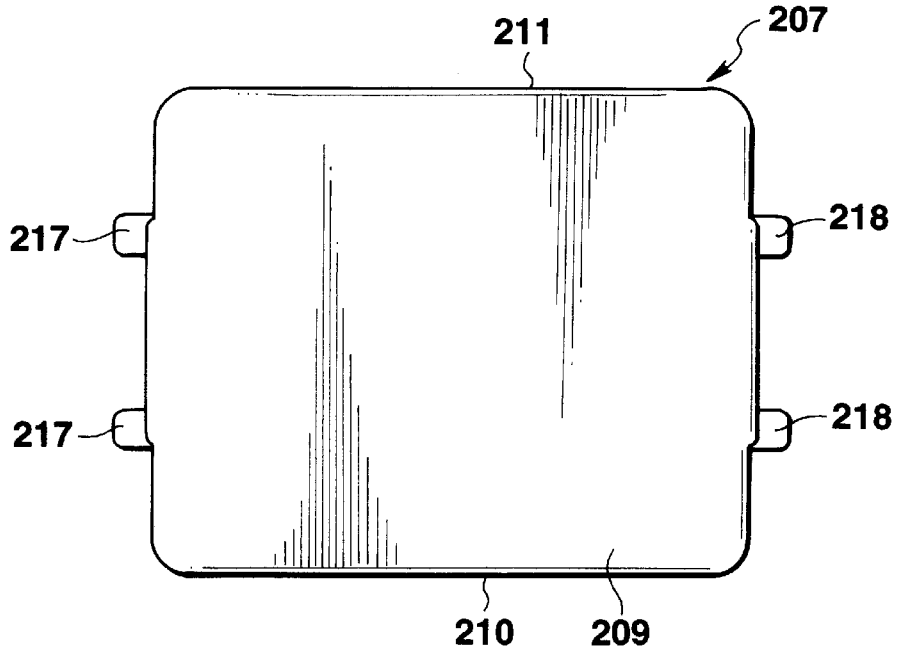
FIG. 25 is a bottom view of a lower case of the additional device of the wristwatch of FIG. 24A.
Figure 26:
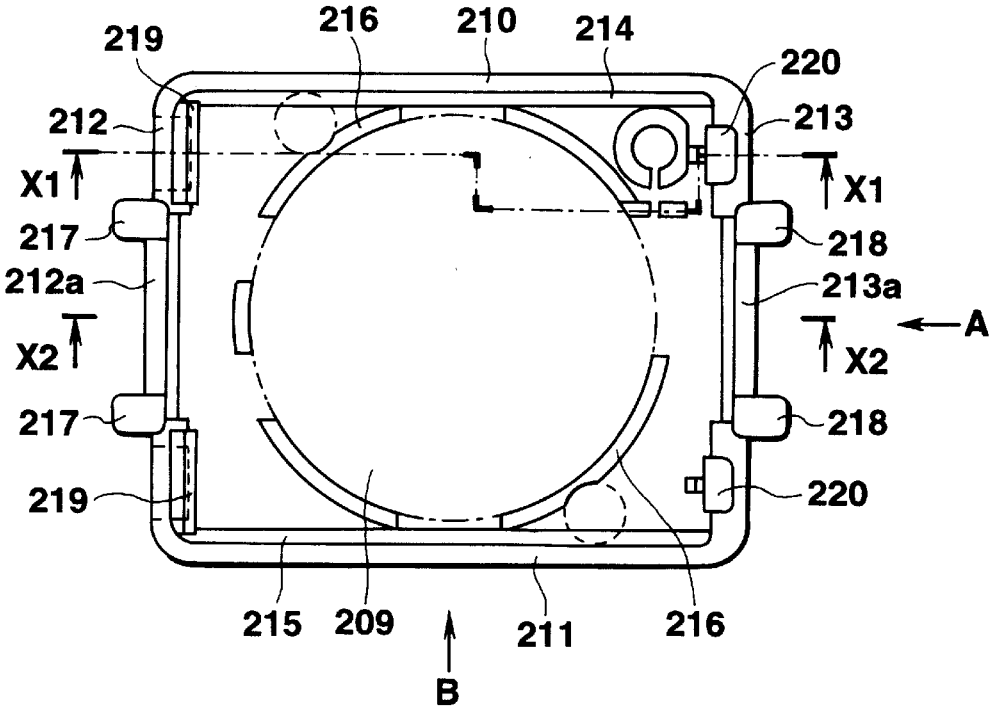
FIG. 26 is a plan view of the lower case.

As shown in FIGS. 25 and 26, the lower subcase 207 includes a rectangular bottom 209, a pair of longer opposite front and rear upstanding sides 211 and 2where the respective upstanding sides 210–213 have the same height.

Figure 27:
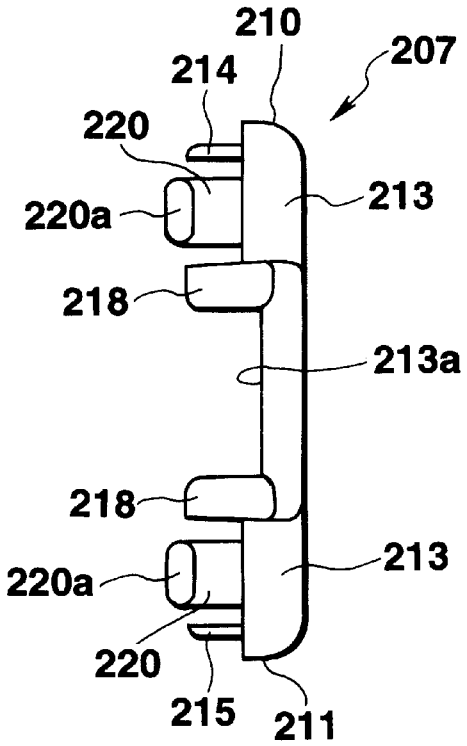
FIG. 27 is a side view of the lower case as viewed in the direction of arrow A in FIG. 26.

A pair of horizontal front and rear ribs 215 and 214 are provided so as to extend close to and inside the pair of front and rear sides 211 and 210, respectively, and as shown in FIG. 27, upward relative to the pair of front and rear sides 211 and 210 from an upper surface of the bottom 209. A plurality of arcuate battery support ribs 216 are arranged along a circle on the upper surface of the bottom 209. A battery 250 (FIGS. 41, 42) which drives a signal reception detecting/reporting 100 is disposed within an area surrounded by the plurality of support ribs 216.

Figure 28:
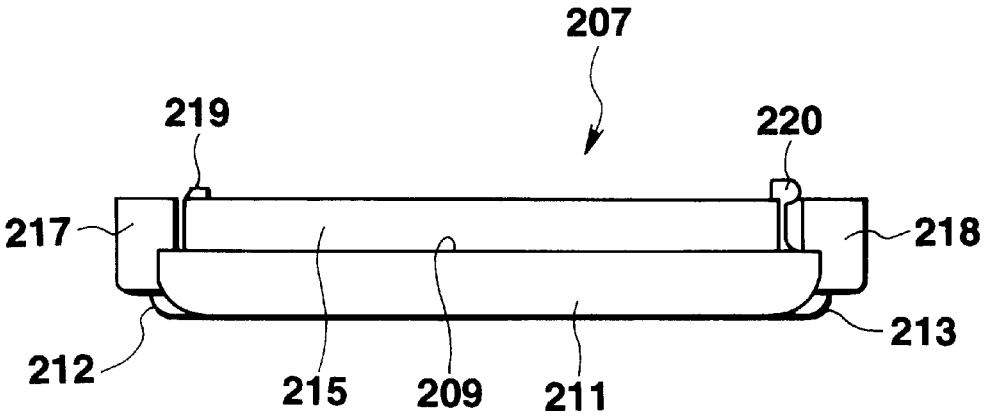
FIG. 28 is a side view of the lower case as viewed in the direction of arrow B in FIG. 26.

The right and left sides 213 and 212 have right and left cuts 213*a* and 212*a* of the same size at the centers thereof, respectively. A pair of right stops 218 are provided each at a respective one of opposite ends of the right cut 213*a*. A pair of left stops 217 are provided each at a respective one of opposite ends of the left cut 212*a*. As shown in FIG. 28, the two pairs of right and left stops 218 and 217 are at positions shifting somewhat outward relative to the right and left sides 213 and 212, respectively, and have the same height as the pair of horizontal ribs 214 and 215.

Figure 29:
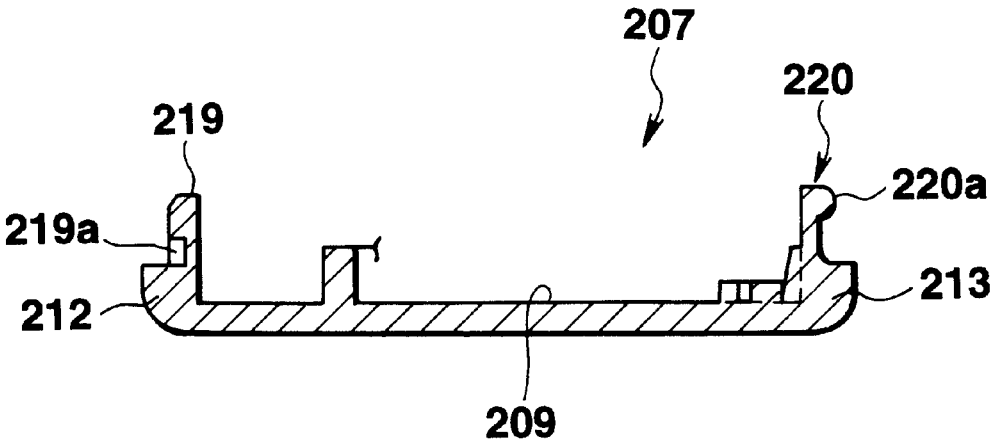
FIG. 29 is a cross-sectional view taken along a line X1—X1 of FIG. 26.
Figure 30:
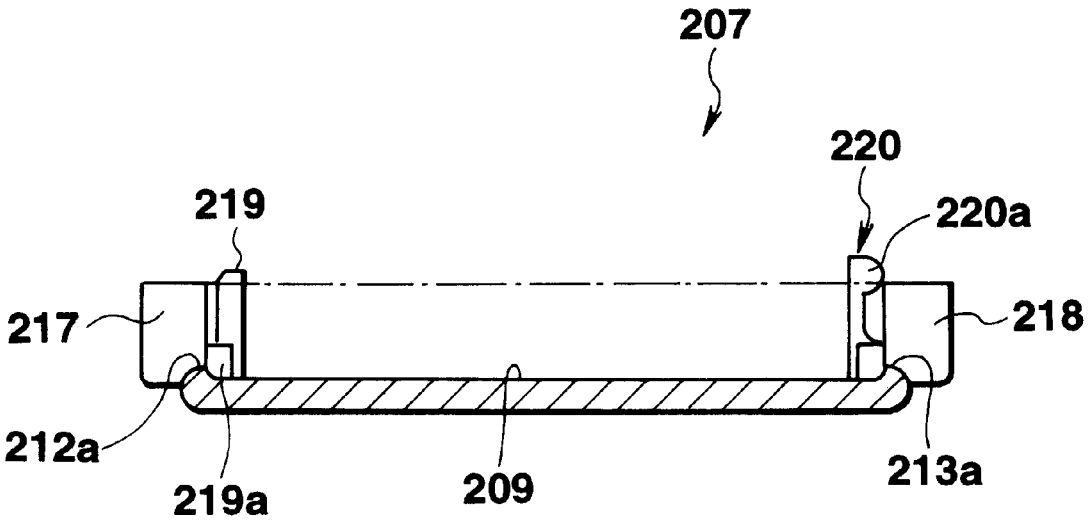
FIG. 30 is a cross-sectional view taken along a line X2—X2 of FIG. 26.

A pair of left hooks 219 are provided each adjacent to a corresponding one of the pair of stops 217 inside the left side 212 and as shown in FIGS. 29 and 30, each have an engaging recess 219*a* on its outer surface at a lower position.

A pair of right hooks 220 are provided each adjacent to a respective one of opposite ends of the right side 213 and each have an outer engaging hemispheric convexity 220*a* at an upper position thereof.

Figure 31:
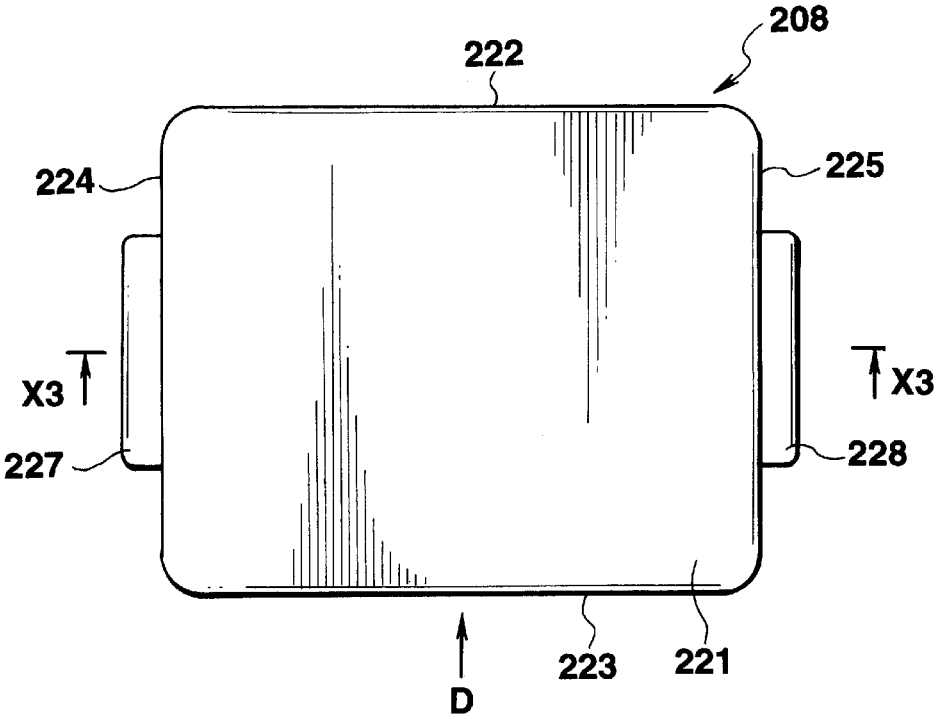
FIG. 31 is a plan view of an upper case of the additional device of FIG. 24A.
Figure 32:
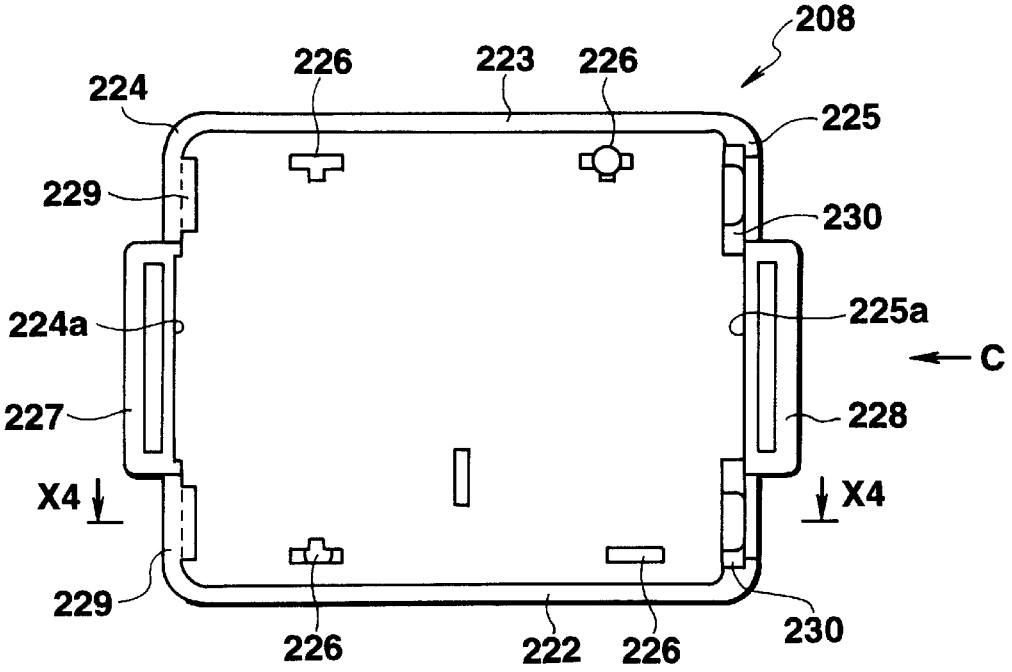
FIG. 32 is a bottom of view of the upper case.

As shown in FIGS. 31 and 32, the upper subcase 208 has an upper rectangular ceiling member 221 of the same shape as the bottom 209 of the lower subcase 207.

The upper subcase 208 has a pair of opposite longer vertical front and rear sides 223 and 222 and a pair of shorter opposite vertical right and left sides 225 and 224. The sides 222–225 have the same height.

A plurality of device support ribs 226 are arranged on the ceiling member 221 for support of a signal reception detecting/reporting device 251 (FIGS. 41, 42) which operates with power from the battery.

A pair of right and left cuts 225*a* and 224*a* are provided on the pair of right and left sides 225 and 224 so as to receive the pair of right stops 218 and the pair of left stops 217, respectively.

Figure 33:
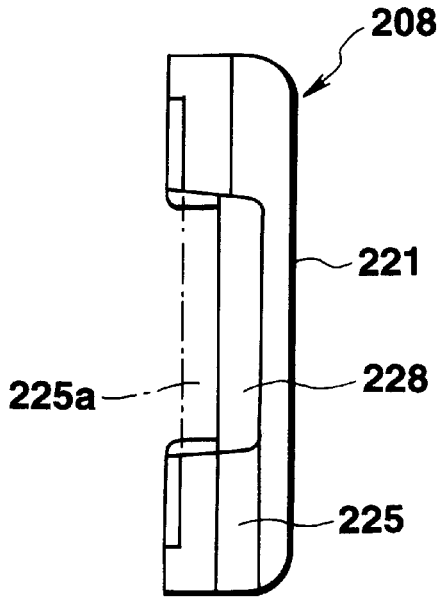
FIG. 33 is a side view of the upper case as viewed in the direction of arrow C in FIG. 32.
Figure 34:
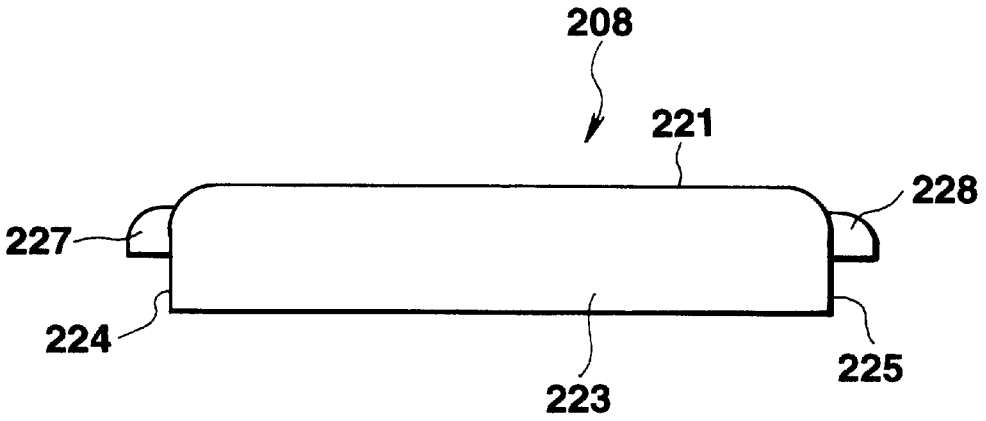
FIG. 34 is a side view of the upper case 1 as viewed in the direction of arrow D in FIG. 31.

As shown in FIGS. 33 and 34, a pair of right and left press members 228 and 227 are provided on the ceiling member 221 outside the pair of right and left cuts 225*a* and 224*a*, respectively.

Figure 35:
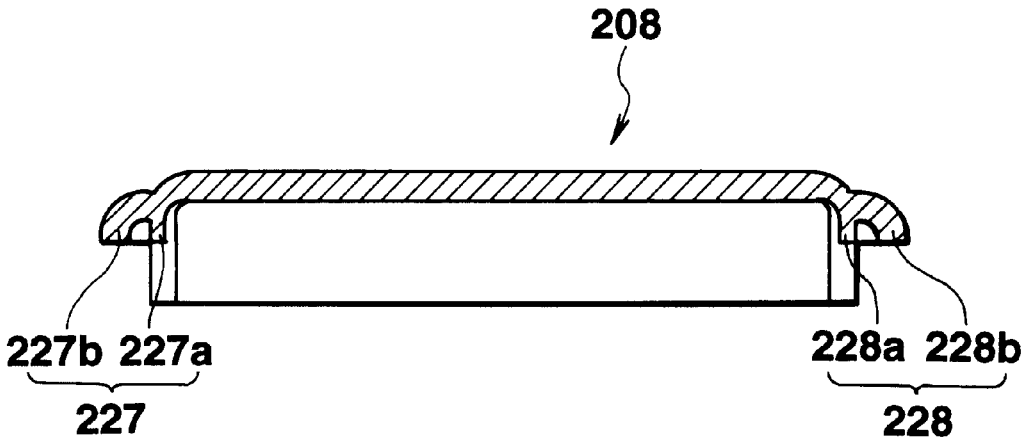
FIG. 35 is a cross-sectional view taken along a line X3—X3 of FIG. 31.

The pair of right and left press members 228 and 227 have widths which can intervene between the right stops 218 of the pair and between the left stops 217 of the pair, respectively. As shown in FIG. 34, the pair of right and left press members 228 and 227 protrude further outward relative to the pair of right and left sides 225 and 224, respectively. As shown in FIG. 35, the pair of right and press members 228 and 227 are composed of a pair of inner and outer members 228*a*, 228*b* and a pair of inner and outer members 227*a*, 227*b*, respectively.

Figure 36:
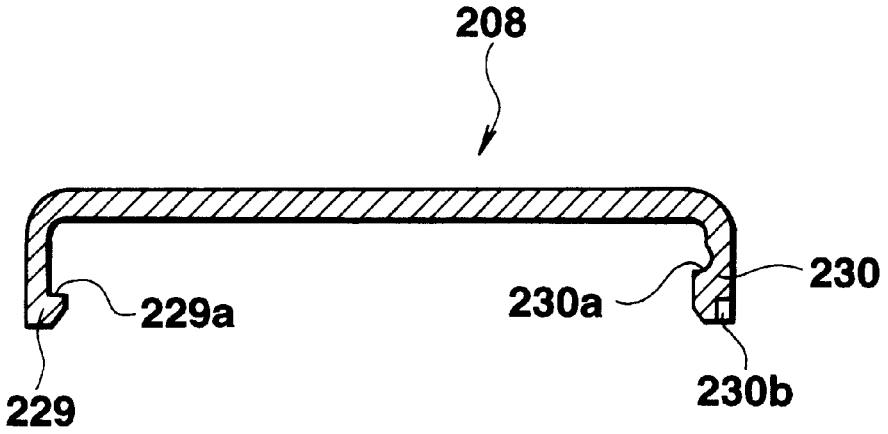
FIG. 36 is a cross-sectional view taken along a line X4—X4 of FIG. 32.

A pair of left hooks 229 are provided on the left side 224 of the upper subcase 208 at positions corresponding to those of the pair of left hooks 219 provided on the lower subcase 207. As shown in FIG. 36, the pair of left hooks 229 each have an internal engaging rib 229*a*.

A pair of right hooks 230 are formed on the right side 225 of the upper subcase 208 at positions corresponding to those of the pair of right hooks 220 provided on the lower subcase 207. As shown in FIG. 36, the pair of right hooks 230 each have an engaging hemispheric recess 230*a* on the upper inside thereof and an opening cut 230*b* on its outer lower end.

Figure 37:
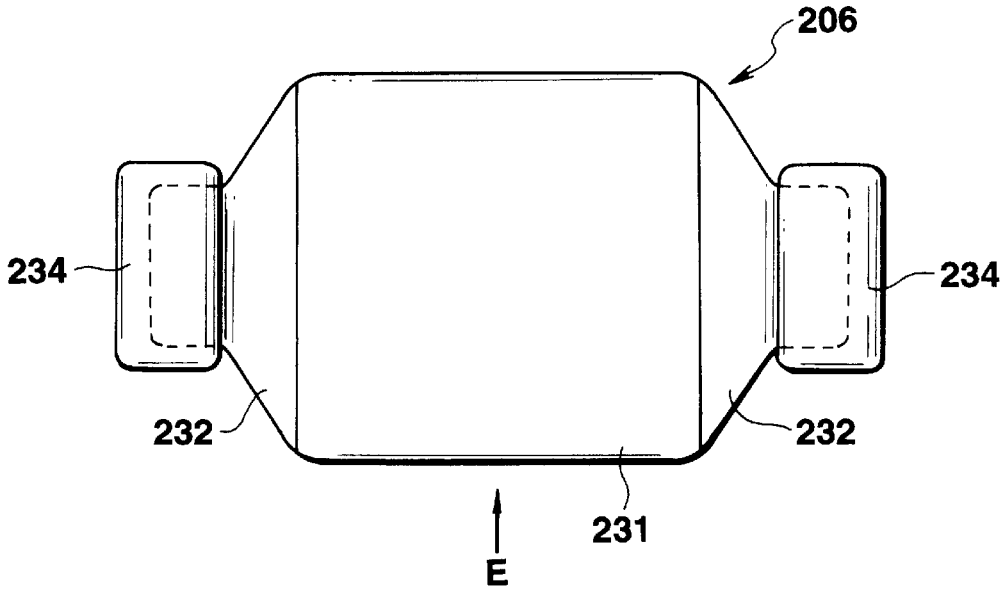
FIG. 37 is a plan view of a connector.

As shown in FIG. 37, the connector 26 has a shape symmetrical with reference to its vertical centerline (not shown) and is made of a strong flexible material of a large frictional coefficient such as silicon rubber. It includes a central rectangular section 231 of a thickness of about 0.5 mm.

A pair of outward tapering and thickening right and left shoulders 232 are provided each integrally with a respective one of opposite ends of the central section 231.

A pair of right and left necks 233, extending upward from an upper surface of the rectangular section 231, are provided integrally with ends of the pair of shoulders 232, respectively, and have widths pressed into between the right stops 218 of the pair and between the left stops 217 of the pair, respectively, on the lower subcase 207.

Figure 38:
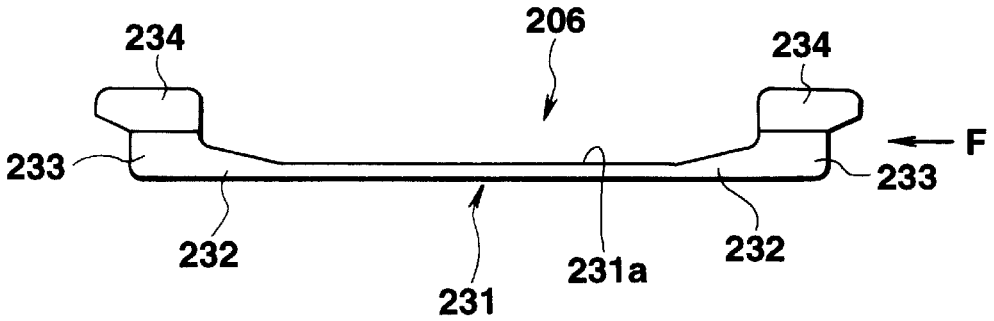
FIG. 38 is a side view of the connector as viewed in the direction of arrow E in FIG. 37.
Figure 39:
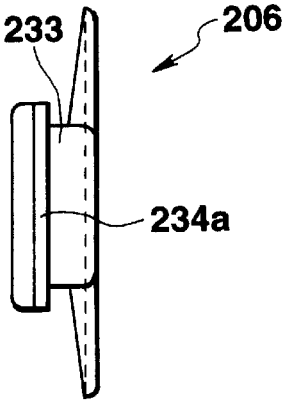
FIG. 39 is a side view of the connector as viewed in the direction of arrow F in FIG. 38.

Each neck 233 has a head 234 integral therewith on the top thereof. The head 234 is much thicker than the central section 231. As shown in FIGS. 38 and 39, the head is larger in size than the neck 233 and extends outward relative to an adjecent neck.

When the connector 206 is attached to the case body 205, the connector 206 is placed under the lower subcase 207.

Figure 40:
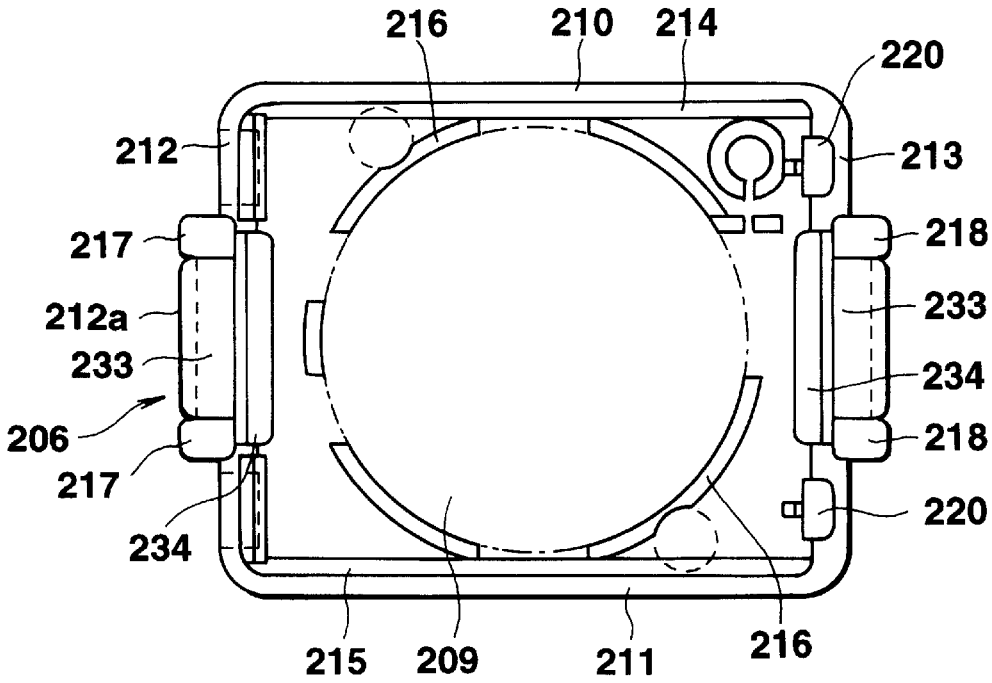
FIG. 40 is a plan view of a lower case to which the connector is attached.

As shown in FIG. 40, the pair of heads 234 are disposed between the right stops 218 of the pair and between the left stops 217 of the pair, resepctively, of the lower subcase 207. The pair of necks 233 are pressed into between the right stops 218 of the pair and between the left stops 217 of the pair, respectively.

The connector 206 has such an overall length that it receives an appropriate tension when it is attached to the lower subcase 207, and hence in this state the connector 206 is not loosened to become an obstacle to handling the device.

Figure 41:
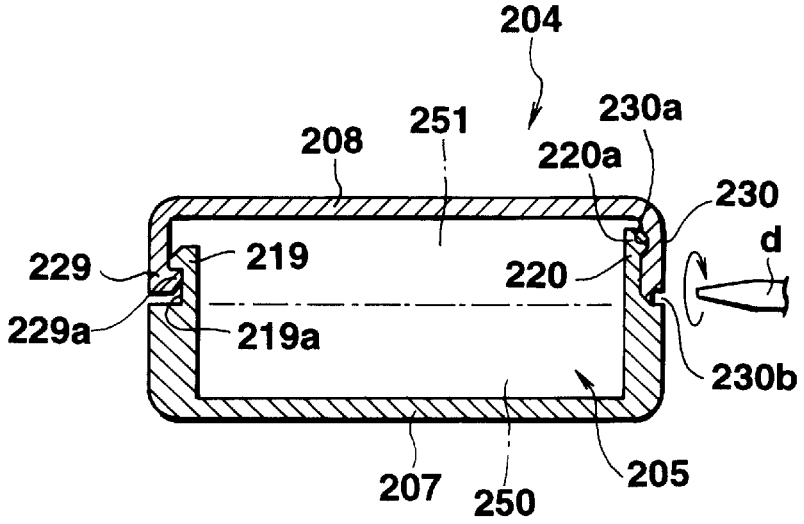
FIG. 41 is a cross-sectional view of combined upper and lower cases taken along a line corresponding to a line X1—X1 of FIG. 26.

After the connector 206 is assembled with the lower subcase 207, the engaging ribs 229*a* of the pair of left hooks 229 provided on the upper subcase 208 are engaged in the corresponding recesses 219*a* of the pair of left hooks 219 provided on the lower subcase 207 (FIG. 41).

The upper subcase 208 is then turned clockwise around the left engaging ends 229*a* by pressing down the right end thereof. Thus, the pair of right hooks 230 provided on the upper subcase 208 are pressed on the outsides of the pair of right hooks 220 provided on the lower subcase 207. As shown in FIG. 41, both the right hooks 220 and 230 are thus engaged at their engaging ribs and recesses 220*a* and 230*a*, respectively.

Thus, both the upper and lower subcases 208 and 207 fit to and abut on each other at their rear sides 222, 210; their front sides 223, 211; their left sides 224, 212; and their right sides 225, 213.

Figure 42:
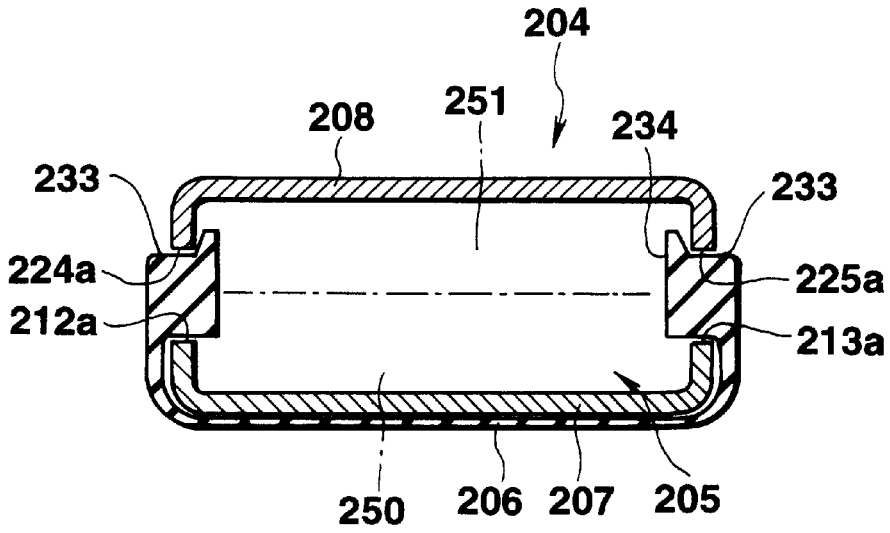
FIG. 42 is a cross-sectional view of the combined upper and lower cases taken along a line corresponding to a line X2—X2 of FIG. 26.

As the upper and lower subcases 208 and 207 fit to each other, the pair of right and left press members 228 and 227 of the upper subcase 208 press on the pair of heads 233 of the connector 206, respectively. That is, as shown in FIG. 42, the pair of heads 233 of the connector 206 are confined in a pair of openings formed by the cuts 213*a*, 225*a* and 212*a*, 224*a* on the subcases 208 and 207, respectively. As a result, the case body 205 becomes integral with the connector 206.

The right and left heads 233 of the connector 206 are pressed between the upper and lower subcases at their right and left cuts 213*a*, 225*a* and 212*a*, 224*a* and to be shrunken and deformed, so that moisture is prevented from entering the case through the openings formed by the right and left cuts 213*a*, 225*a* and 212*a*, 224*a*.

When the additional device 204 which includes the case body 205 and the connector 205 is attached to the wristband 203*b*, a minus screw driver d is inserted into the respective opening recesses 230*b* provided on the right hooks 230 of the upper subcase 208 and then rotated, as shown in FIG. 4. As a result, the engaging ribs 220*a* are disengaged from the recesses 230*a*, so that both the subcases 207 and 208 are easily separated from each other and opened on the side of the opening recess 230*b*.

From between the opened ends of the separated cases 207 and 208, an adjacent one of the heads 234 of the connector 206 is then taken out, the connector 206 is separated from the back side of the wristwatch 10 by pressing the connector down at its taken-out head, and the band 203*b* is then inserted into a resulting gap between the lower subcase 207 and the connector 206.

The taken-out head 234 is then disposed between the pair of right stops 218 of the lower subcase 207, and the head 234 is then pressed into between the pair of right stops 218.

When the upper subcase 208 is then turned downward at its right end, the pair of right hooks 230 of the upper subcase 208 press on the outer sides of the pair of right hooks 220, respectively, of the lower subcase 207.

Thus, both the pair of right hooks 220 and 230 engage each other at their engaging ribs and recesses 220*a* and 230*a*. Thus, both the subcases 207 and 208 again fit into each other, the band 203*b* is inserted into between the connector 206 and the lower subcase 207 and engaged at the other end with the case body 206, and the additional device 204 is attached to the band 203*b*.

In this case, the connector 206 is composed of a flexible material having a large frictional coefficient such as silicon rubber, as mentioned above, so that the additional device 204 is difficult to shift on the band 203*b* or attached in a stable manner to the band to thereby prevent a deterioration in the feeling of wearing the wristwatch due to a possible shift of the additional device 204.

Since the connector 206 is composed of the flexible material, the band 203*b* is attachable to the connector 206 even when it is wider than the case body 205 or changes in thickness, so that the connector finds a wide use.

Since the central section 231 of the connector which contacts with a skin of the user's wrist is wide and has flexibility, it does not interfere with the user's wrist skin, and gives a good feeling of wearing and not a feeling of discomfort.

Since the connector 206 is composed of a highly flexible material such as silicon rubber, it can be molded into a small size to a high degree of freedom of molding, using a mold. This degree of freedom of molding can be combined with the degree of freedom of molding a resin used for molding both the subcases 207 and 208 to produce an additional device which is greatly miniaturized and optimal for use with the wristwatch 10.

In addition, the shoulders 232 of the connector 206 taper, so that the heads 233 are easy to pinch and assemble with associated members of the wrstwatch.

Since the central section 231 is wide, the additional device is attached in a stabilized manner, which is compatible with easy attachment of the additional device.

Generally, provision of both wider and narrower portions on the connector 206 would bring about concentration of a stress in a particular portion thereof when it is extended, so that an area of the connector on which the additional device can be attached would be limited as well as the particular portion may be cracked.

In the present embodiment, however, the tapering shoulders 232 increase in thickness in inverse proportion to the width thereof. Thus, the connector can extend/contract at a constant rate in the area of the shoulders. Thus, in this case, provision of both the wider and narrower portions on the connector 206, does not crack in the particular portion, and brings about stabilized attachment and easy assembly of the additional device.

The heads 234 and necks 233 of the connector which have flexibility similar to that of other portions of the connector 206 sealingly close the openings formed by the cuts 212*a* and 213*a* in both the subcases 207 and 208. Thus, moisture is prevented from entering the cases through the openings.

FIGS. 43–46 show a case for the additional device as a thirteenth embodiment of the present invention in which the fitting structure for an upper subcase 208 and a lower subcase 207 is similar to that of the above embodiments, excluding the following points.

Both the upper and lower subcases 208 and 207 have no cuts such as shown by 213*a* and 212*a* in the above embodiment, and both the subcases 208 and 207 are fitted sealingly to each other.

Two pairs of holders 240 are formed integrally with outer surfaces of right and left sides, resepctively, of the upper subcase 208. Each pair of holders 240 includes a pair of opposite J-like walls 240*a* and a corresponding pair of substantially horizontal support bottoms 240*b* provided at the lower ends of the corresponding J-like walls 240*a*.

A connector 206 is made of a material similar to that of the connector of the above embodiment, and has a pair of rectangular support heads 206*a* each provided at a respective one of opposite ends thereof and each received between a corresponding pair of J-like walls 240*a* of a holder 240 concerned and between a pair of side support bottoms 240*b* of the holder.

In this embodiment, when an additional device 200 is attached to a band 203*a* of the wristwatch 10, any one of the support heads 206*a* is removed from a corresponding one of the pair of holders 240, the connector 206 is then spaced from a back of the band 203*b* by pressing the connector down at the removed support head 206, the wristband 203*b* is then disposed between the pair of lower subcase and the connector, the head 106*a* is then again fitted into between the J-like walls 240*a* of the holder 240 concerned and between the pair of support bottoms 240*b* of that holder. Thus, the wristband 203*b* is tightly held between the connector 206 and the lower subcase 207, so that the additional device 200 is fixed to the watchband 203*b*.

Thus, in this embodiment, when the additional device is attached to the band 203*b*, none of the subcases 207 and 208 are required to be separated from each other, so that attachment is easy and moisture resistance is easily ensured.

While in the particular embodiment the signal reception detecting/reporting device of the portable terminal is illustrated as received within the case, the present invention is not limited to the particular case. Another electronic device may be received.

In summary, the twelfth to thirteenth embodiments have the following compositions:

As shown in FIGS. 24A, B, 37–39, a portable device (wristwatch 10) carried about by a user comprises a portable device body (additional device 204), a predetermined member (band 203*b*), and a connector (206) for fixing the portable device body to said predetermined member (203*b*), wherein: the connector (206) is disposed along the device body and has a length corresponding to the length of the device body, and atached at least one of opposite ends (234) removable to the device body.

As shown in FIGS. 24A, B, the predetermined member (203*b*) comprises a band (203*b*) for the wristwatch body (10).

As shown in FIGS. 24A, B, 27, 37–39, the portable device comprises:

a device body (204) built-in containing function realizing means (100) for realizing a predetermined function; a connector (206) disposed along the device body and having a length corresponding to the device body; and attaching means (217, 218, 234) for attaching at least one of opposite ends of said connector removably to the device body.

As shown in FIGS. 24A, B, the device body (204) is attached to a band (203*b*) for a wristwatch body.

As shown in FIGS. 25–39, the device body comprises a lower subcase (207 of FIGS. 25–30) and an upper subcase (208 of FIGS. 31–36) fitted removably to each other; and the attaching means comprises engaging means (234) formed at opposite ends of the connector (206 of FIGS. 37–39), and restricting means (217, 228) for restricting the engaging means to within said fitted lower and upper subcases (207, 208).

As shown in FIG. 39, the connector (206) comprises a portion pressed and deformed between both said subcases (207, 208) as both the subcases fit to each other.

As shown in FIG. 39, the engaging means (234) is integral with said connector (206) and is thicker than the other portions of the connector.

As shown in FIGS. 37, 38, the connector (206) comprises a first wide central portion (231), a pair of second portions (232) tapering and thickening each outward from a respective one of opposite sides of the first wide central portion, and a pair of third portions (234) each provided at a remote end of a respective one of the pair of second portions and engaged with the device body.

Figure 43:
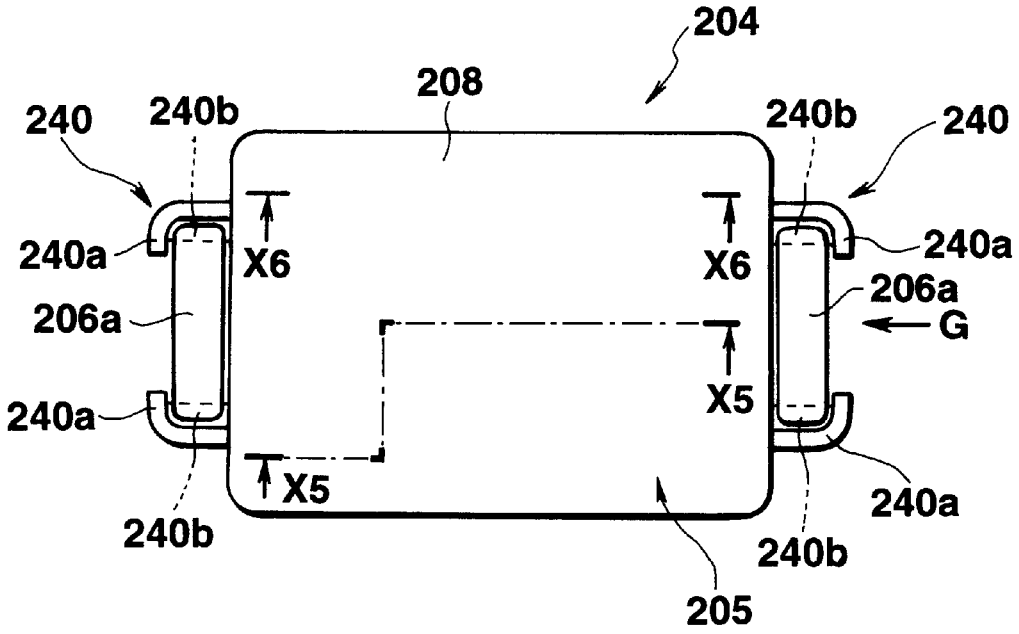
FIG. 43 is a plan view of a case of an additional device as a thirteenth embodiment of the present invention.
Figure 44:
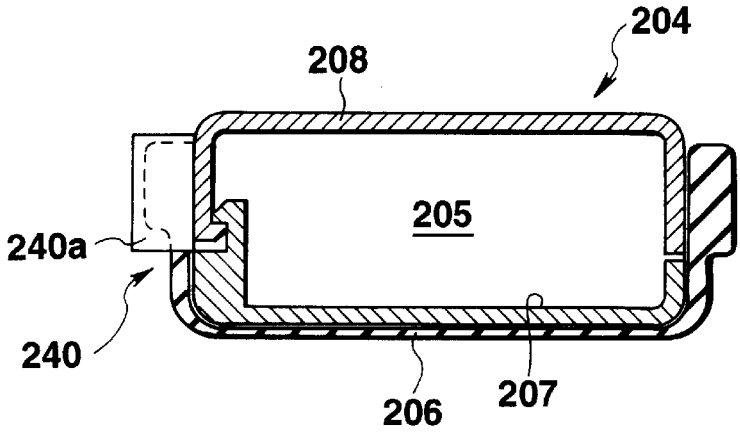
FIG. 44 is a cross-sectional view taken along a line X5—X5 of FIG. 43.
Figure 45:
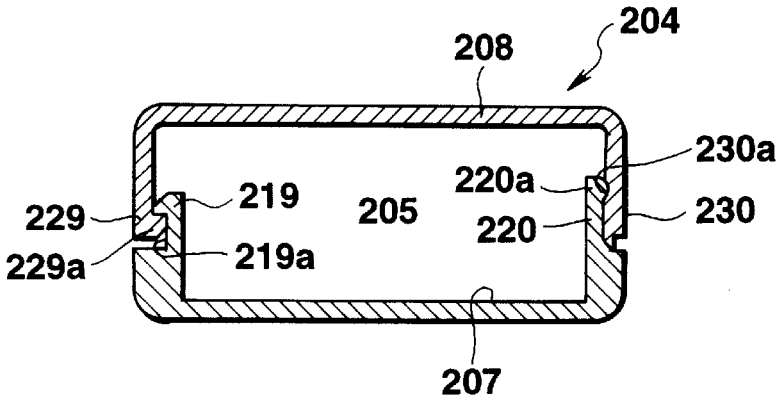
FIG. 45 is a cross-sectional view taken along a line X6—X6 of FIG. 43.
Figure 46:
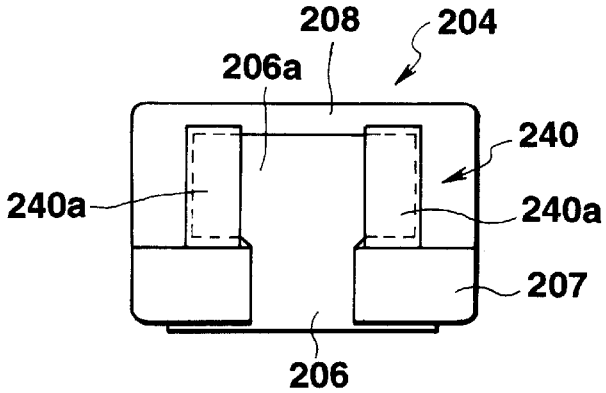
FIG. 46 is a side view of the case of FIG. 43 as viewed in the direction of arrow G.

As shown in FIGS. 43, 44, the attaching means comprises engaging means (240; 240*a*, 240*b*) provided outside the device body; and engaged means (206*a*) provided at an end of the connector (206) for being engaged by the engaging means.

As shown in FIG. 42, the device body comprises a signal reception detecting/reporting device (250) for detecting reception of a signal at a portable terminal and for reporting this fact to the user.

As described above, according to the twelfth and thirteenth embodiments, the band is flexible, so that even when an object on which the additional device is to be attached or a wristband is wider than the case body or varies in thickness, the additional device can be attached to the band. Thus, the inventive attaching structure has versatility. The connector has flexibility, so that even when the wristwatch is worn on the user's wrist and the connector is brought into the contact with the user's wrist skin, it does not interfere with the user's wrist skin, giving no feeling of discomfort to the user.

According to the twelfth and thirteenth embodiments, the case is composed of the removably fitted lower and upper subcases, and the engaging means formed at the opposite sides of the connector are confined within both the fitted subcases. Thus, no means for engaging the connector is required to be provided outside the case body which includes the upper and lower subcases. Thus, the outer surface of the case is smooth without any lugs to thereby prevent the case from interfering with a third party's wear.

According to the twelfth and thirteenth embodiments, since the connector is pressed and deformed between the fitting portions of the upper and lower subcases. Thus, moisture resistance is given to the additional device.

According to the twelfth and thirteenth embodiments, the engaging means are provided integrally with the connector and are thicker than the other remaining portions of the connector. Thus, the connector having such engaging means is easily molded with a mold at low cost. Since the engaging members are thicker than the other remaining portions of the connector, they are not deformed by a tensile force produced when it is attached.

According to the twelfth and thirteenth embodiments, the connector has a first central wide section, a pair of second outward tapering thickening portions each provided at a respective one of opposite ends of the first section, and a pair of third outward extending portions each provided integral with an end of a respective one of the second portions and engaged with the case body. Thus, the first section is put in close contact with the wristband, so that the wristwatch is worn in a stabilized manner. Since the pair of second portions outward taper and thicken, the pair of third portions are easy to pinch when the pair of third portions are engaged with the case body to thereby achieve assembly or disassembly easily. Generally, provision of both wider and narrower portions on the connector brings about concentration of stress and may cause cracks in a particular portion of the connector when the connector is extended. However, the second portions thicken in inverse proportion to the tapering thereof, so that the connector can extend/contract at a constant rate in this area. Thus, even when there are wider and narrower portions on the connector, no cracks occur in the particular portion. Thus, attachment of the wristwatch in the stabilized manner is compatible with easy attachment of the wristwatch without any obstacle. engaging means includes engaging members provided outside the case and corresponding recesses provided at ends of the connector in which the engaging members engage. Thus, even when the case body is composed of an upper and lower subcases, the wristwatch is attached to the band without separating both the subcases from each other.

According to the twelfth and thirteenth embodiments, a signal reception detecting device which detects/reports reception of a signal at the portable terminal is provided within a case. Thus, even when the wristband is wider than the case body or varies in thickness, the signal reception detecting/reporting device is attached to the wristband, which is worn around the user's wrist, giving a good feeling of wearing to the user and not a feeling of wrongness.

What is claimed is:

1. A portable device including detecting means for detecting reception of a signal at a portable terminal, said portable device comprising:

an independent main body that is separate from said portable terminal;

a plurality of turnable-on/off light emitters each disposed at respective positions on said main body;

controls means, responsive to said detecting means detecting reception of a signal at said portable terminal, for turning on/off said plurality of light emitters in accordance with a predetermined turning-on/off sequence to report the reception of the signal to a user.

2. The portable device according to claim 1, wherein said control means comprises means for turning on/off said plurality of light emitters in response to an end of communication of said portable terminal.

3. The portable device according to claim 2, wherein said control means further comprises means for randomly determining one of said plurality of light emitters to be turned on last.

4. The portable device according to claim 3, wherein said control means further comprises means for controlling the light emitter to be turned on last to emit light in a form that is different from a pattern in which the plurality of light emitters are turned on/off in accordance with the predetermined turning on/off sequence.

5. The portable device according to claim 3, further comprising a plurality of indicators respectively corresponding to said plurality of light emitters, and wherein each of said plurality of indicators represents a predetermined sense of play.

* * * * *